US005722025A

United States Patent [19]

Morigami et al.

[11] Patent Number: 5,722,025

[45] Date of Patent: Feb. 24, 1998

[54] FIXING DEVICE

[75] Inventors: Yuusuke Morigami, Toyohashi; Eiji Okabayashi; Takeshi Kato, both of Toyokawa; Tetsuro Ito, Okazaki, all of Japan

[73] Assignee: Minolta Co., Ltd., Osaka, Japan

[21] Appl. No.: 735,539

[22] Filed: Oct. 23, 1996

[30] Foreign Application Priority Data

| | | | |
|---|---|---|---|
| Oct. 24, 1995 | [JP] | Japan | 7-275512 |
| Oct. 25, 1995 | [JP] | Japan | 7-277749 |
| Oct. 31, 1995 | [JP] | Japan | 7-283216 |
| Jan. 12, 1996 | [JP] | Japan | 8-003749 |

[51] Int. Cl.[6] ..... G03G 15/20

[52] U.S. Cl. ..... 399/330; 399/90; 219/216

[58] Field of Search ..... 399/88, 90, 328, 399/330, 67, 69; 219/216, 469–471; 430/124, 126

[56] References Cited

U.S. PATENT DOCUMENTS

| | | | |
|---|---|---|---|
| 4,395,109 | 7/1983 | Nakajima et al. | 219/216 |
| 4,714,819 | 12/1987 | Yamashita | 219/216 |
| 4,724,305 | 2/1988 | Iimura et al. | 219/469 |
| 4,743,940 | 5/1988 | Nagasaka et al. | 399/330 |
| 4,745,431 | 5/1988 | Kogure et al. | 399/69 |
| 4,801,968 | 1/1989 | Kogure et al. | 399/334 |
| 4,810,858 | 3/1989 | Urban et al. | 219/469 |
| 4,813,372 | 3/1989 | Kogure et al. | 219/216 X |
| 4,874,927 | 10/1989 | Shibata et al. | 219/469 |
| 4,888,464 | 12/1989 | Shibata et al. | 219/216 |
| 5,065,193 | 11/1991 | Saitoh et al. | 399/324 |
| 5,115,279 | 5/1992 | Nishikawa et al. | 399/331 |
| 5,288,973 | 2/1994 | Ota et al. | 219/216 |
| 5,303,016 | 4/1994 | Oda et al. | 399/329 |
| 5,408,070 | 4/1995 | Hyllberg | 219/469 |
| 5,420,395 | 5/1995 | Hyllberg et al. | 219/470 |
| 5,616,263 | 4/1997 | Hyllberg | 219/469 |

FOREIGN PATENT DOCUMENTS

| | | |
|---|---|---|
| 54-60931 | 5/1979 | Japan . |
| 55-62474 | 5/1980 | Japan . |
| 57-63570 | 4/1982 | Japan . |
| 59-171980 | 9/1984 | Japan . |
| 3-80279 | 4/1991 | Japan . |
| 4-305679 | 10/1992 | Japan . |

*Primary Examiner*—Matthew S. Smith
*Attorney, Agent, or Firm*—McDermott, Will & Emery

[57] ABSTRACT

A fixing device for heating and fixing an unfixed image to a record member bearing the unfixed image, including a heating roller, a backup member, and a current transmitting units. The heating roller includes a core roller, and a resistance heating member which is formed on the core roller and generates heat when a current is transmitted thereto through the current transmitting units, and is rotatably carried at opposite ends of the core roller by bearing units. The current transmitting units are arranged at positions opposed to the bearing units. The current transmitting unit includes a current receiver member and a current supply member. At mutual contact surfaces of them, the current receiver member has a concave section, and the current supply member has a convex section. The outer periphery circle of at least one side surface of said current receiver member has a radial difference of 6 mm or more with respect to an outer periphery circle of the heating roller at a sheet passing region. The heating roller has dust mevement restricting grooves.

29 Claims, 8 Drawing Sheets

FIXING DEVICE

BACKGROUND OF THE INVENTION

1. Field of the Invention

The present invention relates to a fixing device for heating and thereby fixing an unfixed image such as a toner image to a record member bearing the unfixed image in an image forming apparatus such as a copying machine, printer or the like.

2. Description of the Background Art

A fixing device in an image forming apparatus such as a printer or a copying machine generally includes a backup member (generally, a pressure roller or a pressure belt) adapted such that a record member bearing an unfixed image such as a toner image is held and passed between the backup member and a heating roller.

In many cases, the heating roller includes a heater such as a halogen lamp heater, and the roller is heated by heat radiated from the heater.

However, the heating roller containing the heater such as a halogen lamp heater as a heat source cannot rapidly heat a surface of the heating roller to a predetermined fixing temperature after start of power supply to the heater, so that a long preheating time (i.e., a warming-up time) is required before the fixing device reaches the predetermined temperature after power-on of the image forming apparatus. This prevents easy operation of the apparatus.

An example of a heating roller, which can reduce a temperature rising time for attaining the predetermined temperature, is proposed in Japanese Laid-Open Patent Publication No. 59-189381 (189381/1984). This roller includes a core roller and a resistance heating member arranged around the core roller for integral rotation. The resistance heating member is made of a substance, which generates heat when a current flows therethrough. The heating roller of this type has a good electrothermal converting efficiency, and can rapidly raise the surface temperature of the heating roller to a predetermined temperature after current supply to the resistance heating member, so that the preheating time of the fixing device can be reduced.

In this fixing device employing the above heating roller, a current transmitting unit is generally employed for supplying a current to the resistance heating member. The current transmitting unit is formed of a ring-like current receiver member, which is electrically connected to the resistance heating member and rotates together with the same, and a current supply member which is located at a fixed position and is in slidable contact with the resistance heating member. However, the current transmitting unit of this type may generally suffer from a contact failure between the current receiver member and the current supply member and therefore instable supply of the current to the resistance heating member due to eccentric rotation of the heating roller derived from a manufacturing error of the roller or the like, and more specifically deflection of the heating roller derived from an excessive high contact pressure of the backup member to the roller. In order to prevent the contact failure, the current supply member may be pressed against the current receiver member with an increased pressure. In this case, however, a wear increases at slide contact surfaces of the current supply member and the current receiver member, which reduces a life-time of the current transmitting unit, and causes instable power supply to the resistance heating member.

In view of the above, it is desired that the heating roller may have an improved current transmitting unit for stably supplying a heating current to the resistance heating member of the roller. Examples of the improved rollers are disclosed in Japanese Patent Publication Nos. 4-73797 (73797/1992) and 4-77916 (77916/1992), in which a current transmitting unit is accommodated in a bearing unit rotatably carrying a heating roller, Japanese Laid-Open Patent Publication Nos. 1-177576 (177576/1989), 4-328594 (328594/1992) and 4-326386 (326386/1992), in which a heating roller is rotatably carried by a ball bearing or the like electrically connected to a resistance heating member of the roller for supplying a current to the resistance heating member via the bearing.

However, the structure in which the bearing unit accommodates the current transmitting unit suffers from the following problem. Generally, the bearing unit contains oily lubricant for improving a rotation performance. This oily lubricant may enter the current transmitting unit, in which case an electrical resistance between the current supply member and the current receiver member varies, so that a sufficient heating current cannot be supplied to the resistance heating member. This will be further described below with reference to FIG. 13. FIG. 13 shows a result in which a voltage across opposite ends of the resistance heating member was measured over time while keeping a constant voltage at a power supply connected to the resistance heating member. In the figure, "L2" represents a graph of results of measurement on the heating roller which has a current transmitting unit accommodated in a bearing unit. It can be seen from the graph L2 that a resistance value of the current transmitting unit increases with time due to entry of oily substance, so that a voltage drop at the current transmitting unit increases, and thus the voltage applied to the resistance heating member lowers. When the voltage applied to the resistance heating member lowers, the current flowing through the resistance heating member decreases, and therefore a heat value due to Joule loss at the resistance heating member decreases, so that a longer time is required for raising the temperature of the heating roller. Apart from the problem of entry of the oily substance, flow of the current through the current transmitting unit causes heat generation at the current transmitting unit due to the resistivity of the current transmitting unit itself, so that the temperature of the current transmitting unit may rise above that of the heating roller. Further, since the current transmitting unit is located at the bearing unit, bearing members are required to have a heat resistance, which increases its manufacturing cost.

In the case where the heating roller is rotatably carried by a bearing such as a ball bearing electrically connected to the resistance heating member, the bearing itself forms the current transmitting member if the current is transmitted to the resistance heating member via the bearing. Therefore, the bearing as well as oily lubricant in the bearing must be electrically conductive, which further increases the manufacturing cost of the bearing unit.

Similarly to the case where the current transmitting unit is accommodated in the bearing unit, the bearing and the oily substance must have a heat resistance in view of heat generation by the power supply. This also increases the cost of the bearing unit.

Further, the heating roller is subjected to a high contact pressure by the backup member, so that the bearing rotatably carrying the heating roller generally wears to a high extent. Therefore, a current cannot be stably supplied to the resistance heating member for a long term due to the fact that the bearing unit which is liable to wear rapidly is used as the current transmitting unit.

Further, the current transmitting unit of the general type described above suffers from the following problems.

One of the problems is that current transmission failure occurs due to deviation or shift between the contact surfaces for current transmission of the current supply member and the current receiver member, when a relative lateral vibration or the like occurs between these members. Another problem is that the fixing device must have a compact structure for reducing sizes of the image forming apparatus, and therefore the current transmitting unit may be required to have reduced sizes. In this case, the current supply member and the current receiver member have a small contact area, so that oxidation of the contact surfaces is liable to occur due to significant heating of the current transmitting unit, when a current, which is large in view of the small contact area, flows therethrough for heating the heating roller to a predetermined fixing temperature. When oxidized, the resistance value increases, resulting in a current transmission failure.

For overcoming the above problems, a current supply member may be fitted into a groove of a ring-shaped current receiver member and may be in contact with a bottom of the groove, as taught by Japanese Patent Publication No. 7-7232 (7232/1995). In this case, side walls of the groove can prevent relative movement or shift between contact surfaces for current transmission of the current supply member and the current receiver member. However, this structure cannot overcome the problems relating to heating and oxidation of the members due to the contact resistance thereof.

In the current transmitting unit of the above type, the current supply member may have a flat surface which is in contact with a peripheral surface of the current receiver member. In this case, however, a contact area between these members is significantly small, so that a contact resistance is large. Therefore, a large heat is liable to be generated, so that both the members are liable to be impaired. Accordingly, the current supply member has a curved surface extending along and mating with the peripheral surface of the current receiver member, as disclosed in Japanese Laid-Open Patent Publication No. 4-213480 (213480/1992).

However, in the structure where the current supply member has the curved surface extending along and mating with the peripheral surface of the current receiver member, a radius of curvature of the curved contact surface of the current supply member is strictly set to a value equal to the radius of curvature of the contact surface of the current receiver member without a margin, as disclosed in Japanese Laid-Open Patent Publication No. 4-213480. Therefore, initial decentering of the heating roller itself and decentering after use may cause radial vibration during rotation of the heating roller. Also, the heating roller may cause bound due to variation in load which occurs when a record member is transported between the rotating heating roller and the backup member pressed against the heating roller. In these cases, a contact pressure of the current supply member against the current receiver member varies, or a current supply member 120 swings as shown in FIG. 14 , so that instable contact occurs between the current supply member 120 and a current receiver member 110 in a heating roller 1R. This results in electric noises or separation of these members.

Even in the case where the contact pressure between the current supply member and the current receiver member is sufficiently large, the following problem may occur. Due to radial vibration and/or bound of the heating roller, an instantaneous force occurs in a direction different from the intended contact direction of the current receiver member with respect to the current supply member, so that a local stress is temporarily concentrated at a portion of the current supply member, which may break the current supply member.

In an operation of attaching the heating roller to the fixing device, a fine adjustment is required for appropriate contact between the current receiver member and the current supply member having the contact surface of a radius of curvature equal to that of the current receiver member, which lowers an operation efficiency in the assembly process of the fixing device.

In the heating roller having the current transmitting unit of the above type, wear powder produced by slide contact between the current supply member and the current receiver member of the current transmitting unit may move or flow to a sheet passing region on the heating roller, i.e., a region over which a record member bearing an unfixed image such as a toner image is passed. This impairs an image quality of the fixed image. Also the powder may move to a bearing rotatably carrying the heating roller, which causes rotation failure of the heating roller.

The toner powder and paper powder generated at the sheet passing region may enter the bearing to cause rotation failure of the heating roller. Also, they may move onto the slide contact surfaces of the current receiver member and the current supply member of the current transmitting unit, in which case an electrical resistance value between the supply and receiver members varies, and/or contact failure occurs, so that the current transmitting unit cannot stably supply a voltage to the resistance heating member.

Further, the bearing unit generally contains lubricant oil for improving the rotation performance. This oil may flow into the sheet passing region to reduce the image quality of the fixed image. Also, the oil may flow between the slide contact surfaces of the supply and receiver members of the current transmitting unit, in which case the electrical resistance value between the supply and receiver members may vary, and/or contact failure may occur, so that the current transmitting unit cannot stably supply a voltage to the resistance heating member.

As already described, the toner powder, paper powder, oil or the like may move onto the slide contact surfaces of the current supply member and the current receiver member, in which case a voltage across the opposite ends of the resistance heating member lowers as shown in FIG. 13. Thereby, the resistance value of the current transmitting unit increases with time due to entry of oil or the like, and the voltage drop at the current transmitting unit increases, so that the voltage across the opposite ends of the resistance heating member lowers. Since reduction in voltage across the opposite ends of the resistance heating member results in lowering of the heating value of the resistance heating member, a speed of temperature rising of the heating roller lowers.

In order to overcome the above problems, (1) Japanese Utility Mode Publication No. 6-3399 (3399/1994) has disclosed a fixing device, in which a current transmitting unit is entirely covered with a cover member, and a cleaning member made of a sponge member is arranged between the cover member and the heating roller. (2) Japanese Laid-Open Utility Model Publication No. 60-150570 (150570/1985) has disclosed a fixing device, in which a current transmitting unit arranged at a heating roller is covered with an electrically conductive ring, and current supply is performed via a current supply member fitted into a groove formed at the conductive ring. (3) As disclosed in Japanese Patent Publication No. 4-73797 (73797/1992), a current transmitting unit may be accommodated in a bearing rotatably carrying a heating roller.

However, the fixing device taught by Japanese Utility-Model Publication No. 6-3399 requires a complicated structure and therefore is expensive. Also, the resistance heating member may be damaged due to the structure in which the cleaning member is in slide contact with a resistance heating member arranged at an outer peripheral surface of the heating roller. Further, due to wear of the cleaning member over time, toner powder or the like at a sheet passing region may move to the current transmitting unit, and wear powder of the cleaning member may move to the sheet passing region.

According to the fixing device taught by Japanese Laid-Open Utility Model Publication No. 60-150570, it is possible to prevent movement of the toner powder or the like at the sheet passing region to the current transmitting unit, and is also possible to prevent movement of the wear powder at the current transmitting unit to the sheet passing region. However, the structure requires a complicated structure and therefore is expensive. The structure in which the current supply member is fitted into the groove of the electrically conductive member requires a long time for assembly, disassembly or the like.

According to the fixing device taught by Japanese Patent Publication No. 4-73797, it is impossible to prevent movement of toner powder and paper powder to the bearing and the slide contact surfaces at the current transmitting unit. Also, it is impossible to prevent movement of the oil in the bearing to the slide contact surfaces at the current transmitting unit accommodated in the bearing. Further, it is impossible to prevent movement of wear powder at the current transmitting unit to the bearing.

SUMMARY OF THE INVENTION

An object of the invention is to provide a fixing device capable of stably supplying a current to a resistance heating member of a heating roller.

Another object of the invention is to provide a fixing device capable of suppressing influences, which are exerted on a current transmitting unit for supplying a current to a resistance heating member of a heating roller, and are caused by eccentric rotation of the heating roller and vibration of a periphery of the roller due to an error such as manufacturing error of the heating roller, and bending of the roller by a contact pressure applied by a backup member, while sufficiently suppressing entry of oil or the like into the current transmitting unit, and thereby capable of stably supplying a current to the resistance heating member.

Still another object of the invention is to provide a fixing device, which can stably supply a current to a resistance heating member of a heating roller without requiring particular characteristics such as heat resistance at the current transmitting unit, and therefore can be inexpensive.

Yet another object of the invention is to provide a fixing device, which can suppress shift between a current receiver member on a heating roller and a current supply member in contact with the same both forming a current transmitting unit for supplying a current to a resistance heating member of the heating roller, and thereby can stably supply a current to a resistance heating member.

A still another object of the invention is to provide a fixing device, in which a current receiver member on a heating roller and a current supply member in contact with the same both forming a current transmitting unit for supplying a current to a resistance heating member of the heating roller can be in contact with each other through a large area even if these member do not have large sizes, so that the current transmitting unit can have a compact structure, and heat generation due to a contact resistance between these members is suppressed, whereby oxidation of the current transmitting unit is suppressed and stable current supply is allowed.

A further another object of the invention is to provide a fixing device, in which even vibration or bounding of a heating roller during rotation causes neither generation of unignorable electrical noises nor separation between a current supply member and a current receiver member in a current transmitting unit for supplying a current to a resistance heating member on the heating roller, and thereby a current can be stably supplied to the resistance heating member.

A further object of the invention is to provide a fixing device, in which even vibration or bounding of a heating roller during rotation do not cause breakage of a current supply member and a current receiver member in a current transmitting unit for supplying a current to a resistance heating member on the heating roller.

A still further object of the invention is to provide a fixing device, in which a current receiver member connected to a resistance heating member on a heating roller and a current supply member to be in contact with the current receiver member can be easily assembled into a fixing device body with a predetermined mutual relationship, allowing easy assembly.

A further object of the invention is to provide a fixing device, in which it is possible to suppress movement of toner powder and paper powder generated at a sheet passing region on a heating roller (i.e., region through which a record sheet bearing an unfixed image such as a toner image is passed) to a current transmitting unit provided for supplying a current to a resistance heating member of the heating roller, and/or it is possible to suppress movement of oil or the like to the current transmitting unit from means rotatably carrying the heating roller, so that a current can be stably supplied to the resistance heating member.

A further object of the invention is to provide a fixing device which can be stably used for a long term.

In view of the above object, the present invention provides a fixing device for heating and fixing an unfixed image to a record member bearing the unfixed image which includes:

a heating roller;

a backup member holding and passing the record member between the heating roller and the same; and current transmitting means for transmitting a current to the heating roller, wherein the heating roller includes a core roller, and a resistance heating member which is formed along an outer or inner peripheral surface of the core roller for integral rotation with the same, and generates heat when a current is transmitted thereto through the current transmitting means, and is rotatably carried at opposite ends of the core roller by carrying means, and the current transmitting means is arranged at a position opposed to the carrying means with a wall of the core roller therebetween.

In view of the above object, the invention also provides a fixing device for heating and fixing an unfixed image to a record member bearing the unfixed image, which includes:

a rotatably carried heating roller;

a backup member holding and passing the record member between the heating roller and the same; and current transmitting means for transmitting a current to the heating roller, wherein the heating roller includes a core roller, and a resistance heating member which is formed at the core roller for rotation together with the core roller and generates heat when a current is transmitted thereto through the current transmitting means, and the current transmitting means includes rotary current receiver members electrically connected to the resistance heating member and arranged at the core roller, and current supply members being in slidable contact with the rotary current receiver members, respectively, each of the current receiver members being in contact with the current supply member has at least one convex or concave contact surface, and each of the current supply members has a concave or convex contact surface being complementary in shape to and in contact with the convex or concave surface of the current receiver member.

In the fixing device of the above type, each of the current supply members may be carried by a current supply member carrying holder and in contact with the corresponding current receiver member, and the current supply member carrying holder may be movably carried by holder carrying means allowing movement in a direction crossing a moving direction for contact of the current supply member with the current receiver member so as to allow contact of the current supply member with the current receiver member in accordance with a shift of the current receiver member in a direction crossing the moving direction for contact.

In any case, the fixing device of the above type may include the current supply member and the current receiver member having the following structures.

(a) The resistance heating member is formed along an outer or inner peripheral surface of the core roller. The current receiver member is electrically connected to the resistance heating member and has a ring-like configuration concentric with the core roller. The current supply member is in slidable contact with an outer peripheral surface of the ring-like current receiver member, if the resistance heating member is located on the outer peripheral surface of the core roller. The current supply member is in slidable contact with an inner peripheral surface of the current receiver member, if the resistance heating member is located on the inner peripheral surface of the core roller.

In this case, and particularly in the structure where the holder carrying means movably carries the current supply member carrying holder, the direction crossing the contact and moving direction of the current supply member with respect to the current receiver member is the same as the direction of a rotation axis of the core roller.

(b) The resistance heating member is formed along an outer or inner peripheral surface of the core roller, and the current receiver member is electrically connected to the resistance heating member, has a block-like configuration such as a circular plate-like form or a shaft-like form having a circular section, and is located on a plane substantially perpendicular to the rotation axis of the core roller and around the rotation axis of the core roller. The current supply member is in slidable contact with an outer surface of the block-like current receiver member, the outer surface being located at an outer position of the receiver member in the direction parallel to the rotation axis of the core roller.

In this case, and particularly in the structure where the holder carrying means movably carries the current supply member carrying holder, the direction crossing the contact and moving direction of the current supply member with respect to the current receiver member is substantially perpendicular to the direction of a rotation axis of the core roller.

In any case, the convex shape of the surface provided for current transmission at the current receiver member or the current supply member may be selected from various shapes, and specifically may have a triangular section, trapezoidal section, arc-shaped section or the like. The concave shape of the surface corresponding to the convex shape may be selected from various shapes. In any case, a top of the convex form and/or a bottom of the concave form may be recessed to form a space for enabling smooth contact between the surfaces. Foreign particles may be escaped into the space, although this depends on its size.

In the structure where the current supply member is provided with a plurality of convex surfaces (or concave surfaces) and the current receiver member is provided with the corresponding concave or convex surfaces, this structure may also be regarded that the current supply member is provided with concave surfaces (convex surfaces) and the current receiver member is provided with corresponding convex or concave surfaces.

In view of the above object, the present invention further provides a fixing device for heating and fixing an unfixed image to a record member bearing the unfixed image, which includes:

a rotatably carried heating roller;

a backup member holding and passing the record member between the heating roller and the same; and current transmitting means for transmitting a current to the heating roller, wherein the heating roller includes a core roller and a resistance heating member formed along an outer peripheral surface of the core roller for rotation together with the core roller and is adapted to generate heat when a current is transmitted thereto through the current transmitting means; and the current transmitting means includes circular ring-like rotary current receiver members electrically connected to the resistance heating member and arranged at the core roller, and current supply members being in slidable contact with outer peripheral surfaces of the rotary current receiver members, respectively, each of the current supply members has a curved concave surface being in contact with the outer peripheral surface of the current receiver member and extending in the circumferential direction of the current receiver member, and a curvature radius (radius of curvature) R1 of an arc in the same direction as the circumferential direction of the current receiver member at the curved concave surface and a radius R2 of an outer periphery circle of the current receiver member being in contact with the arc satisfy a relationship of $R2<R1$.

In this device, it is preferable that a width of the current supply member in the direction of the rotation axis of the heating roller is equal to or smaller than a width of the current receiver member in the same direction.

In view of the above object, the present invention further provides a fixing device for heating and fixing an unfixed image to a record member bearing the unfixed image, which includes:

a rotatably carried heating roller;

a backup member holding and passing the record member between the heating roller and the same; and current transmitting means for transmitting a current to the heating roller, wherein the heating roller includes a core roller and a resistance heating member formed along an inner peripheral surface of the core roller for rotation together with the core roller and is adapted to generate heat when a current is transmitted thereto through the current transmitting means; and the current transmitting means includes circular ring-like rotary current receiver members electrically connected to the resistance heating member and arranged at the core roller, and current supply members being in slidable contact with inner peripheral surfaces of the rotary current receiver members, respectively, each of the current supply members has a curved convex surface being in contact with the inner peripheral surface of the current receiver member and extending in the circumferential direction of the current receiver member, and a curvature radius (radius of curvature) R3 of an arc in the same direction as the circumferential direction of the current receiver member at the curved convex surface and a radius R4 of an inner periphery circle of the current receiver member being in contact with the arc satisfy a relationship of R3<R4.

In this device, it is preferable that a width of the current supply member in the direction of the rotation axis of the heating roller is equal to or smaller than a width of the current receiver member in the same direction.

In the fixing devices of the above two types, the current receiver member rotates in accordance with rotation of the heating roller. Meanwhile, the current supply member is usually located at a constant position. The current supply member is usually pressed against the current receiver member by appropriate pressing means such as a spring.

In the structure where the current supply member has the curved concave surface in contact with the current receiver member and the relationship of R2<R1 is satisfied, it is preferable that R1 is 1.1 to 2.0 times larger than R2, and more preferably, is 1.2 to 1.5 times larger than R2, because, if the curvature radius R1 of the curved concave surface were excessive large, a contact area between the current supply member and the current receiver member would be excessively small.

In the structure where the current supply member has the curved convex surface in contact with the current receiver member and the relationship of R3<R4 is satisfied, it is preferable that R3 is substantially equal to 1/1.1 to 1/2.0 of R4, and more preferably, is substantially equal to 1/1.2 to 1/1.5 of R4, because, if the curvature radius R3 of the curved convex surface were excessive small and therefore were excessively sharp, a contact area between the current supply member and the current receiver member would be excessively small.

In view of the above object, the present invention further provides a fixing device for heating and fixing an unfixed image to a record member bearing the unfixed image, which includes:

a rotatably carried heating roller;

a backup member holding and passing the record member between the heating roller and the same; and current transmitting means for transmitting a current to the heating roller, wherein the heating roller includes a core roller and a resistance heating member formed along an outer peripheral surface of the core roller for rotation together with the core roller and is adapted to generate heat when a current is transmitted thereto through the current transmitting means, the current transmitting means includes rotary current receiver members electrically connected to the resistance heating member and arranged at the core roller, and current supply members being in slidable contact with the rotary current receiver members, respectively, and the outer peripheral surface of the heating roller is provided at the vicinity of each of the current receiver members with at least one dust movement restricting groove over the entire periphery of the heating roller.

The "dust" in the above "dust movement restricting groove" means foreign substances such as wear powder generated by slide contact between the current supply member and the current receiver member, toner powder and/or paper powder generated at a record member passing region, i.e., a region on the heating roller over which the record member passes, and/or lubricant oil at a bearing unit for rotatably carrying the heating roller.

The dust movement restricting groove is arranged at one or more position near each of the current receiver members, and may be selectively located at the following specific positions. In the following examples, the position of the groove is defined based on the positions relationship in the direction of the rotation axis of the heating roller.

(1) Position between the current receiver member and the record member passing region (in the structure where the heating roller bearing rotatably carrying the heating roller is spaced from the record member passing region with the current receiver member therebetween).

(2) Position between the current receiver member and the heating roller bearing (in the structure where the current receiver member is spaced from the record member passing region with the heating roller bearing therebetween, or the heating roller bearing is spaced from the record member passing region with the current receiver member therebetween).

(3) Position between the heating roller bearing and the record member passing region (in the structure where the current receiver member is spaced from the record member passing region with the heating roller bearing therebetween).

Among the above positions (1)–(3), only one may be selected for the groove, or combination of them may be selected for the grooves. These positions are appropriately selected depending on an intended performance of the fixing device.

According to the structure employing the groove at the position of the above (1), it is possible to prevent or suppress effectively movement of wear powder generated by slide contact between the current supply member and the current receiver member to the record member passing region, movement of toner powder and paper powder generated at the record member passing region to the current transmitting means and therefore to the heating roller bearing located outside the same, and movement of oil at the heating roller bearing to the record member passing region.

According to the structure employing the groove at the position of the above item (2), it is possible to prevent or suppress efficiently movement of wear powder generated at the current transmitting means to the heating roller bearing, and movement of oil at the heating roller bearing to the current transmitting means and therefore to the record member passing region in the structure where the heating roller bearing is spaced from the record member passing region with the current receiver member therebetween. In the structure where the current receiver member is spaced from the record member passing region with the heating roller bearing therebetween, it is possible to prevent or suppress effectively movement of oil at the heating roller bearing to the current transmitting means, and movement of the wear powder at the current transmitting means to the heating roller bearing and therefore to the record member passing region.

According to the structure employing the groove at the position of the above item (3), it is possible to prevent or suppress effectively movement of toner powder and paper powder at the record member passing region to the heating roller bearing and therefore to the current transmitting means, and movement of oil at the heating roller bearing and wear powder at the current transmitting means to the record member passing region.

The dust movement restricting groove desirably has a width of about 1.0 mm or more in the direction of the rotation axis of the heating roller, and has a depth of about 0.4 mm or more. More preferably, the groove has a width of 1.0 mm or more and a depth of 0.6 mm or more.

Upper limits of the width and depth of the groove depend on the structure, manufacturing process and others of the heating roller, and are generally about 10 mm and abut 6 mm, respectively.

In view of the above object, the present invention further provides a fixing device for heating and fixing an unfixed image to a record member bearing the unfixed image, which includes:

a rotatably carried heating roller;

a backup member holding and passing the record member between the heating roller and the same; and current transmitting means for transmitting a current to the heating roller, wherein the heating roller includes a core roller and a resistance heating member formed along an outer (or inner) peripheral surface of the core roller for rotation together with the core roller and is adapted to generate heat when a current is transmitted thereto through the current transmitting means, the current transmitting means includes ring-shaped rotary current receiver members electrically connected to the resistance heating member and arranged at the core roller, and current supply members being in slidable contact with the rotary current receiver members, respectively, and an outer (or inner) periphery circle of at least one side surface of each current receiver member has a radial difference of 6 mm or more with respect to an outer (or inner) periphery circle of a record member passing region at the heating roller.

The record member passing region on the heating roller through which the record member passes is generally covered with a release layer having a releasing property for promoting release of the heated image from the heating roller when the record member is held and passed between the heating roller and the backup member (generally, pressure roller or pressure belt) opposed thereto. Therefore, the outer periphery circle at the record member passing region of the heating roller is generally defined by the outer periphery circle of the release layer. In any case, the outer (or inner) periphery circle at the record member passing region of the heating roller means the radially outermost (or innermost) periphery circle at the record member passing region of the heating roller.

The above difference, which is 6 mm or more, is preferably 8 mm or more, and more preferably 10 mm or more. The upper limit depends on the structure, manufacturing, assembly and disassembly of the heating roller and current transmitting means, and is generally 60 mm or less.

In any case, the core roller is usually made of metal such as aluminum alloy or iron alloy for providing a sufficient rigidity and a heat conductivity at the heating roller.

The resistance heating member causes Joule heating when a current flows therethrough. For example, the resistance heating member may be made of barium titanate ceramics having a positive temperature coefficient of resistance. If the core roller is electrically conductive, an insulating layer is generally provided for providing insulation between the core roller and the resistance heating member formed along the outer or inner peripheral surface of the core roller. This insulating layer desirably has a breakdown voltage larger than a maximum voltage applied to the resistance heating member in view of safety. The insulating layer may be made of heat resistant insulating resin such as polyimide or polyamidimide.

The heating roller may be provided at a portion, which is brought into contact with the record member, with the release layer so as to promote release and separation of the heated image from the heating roller, after the record member (generally, paper sheet or transparent resin sheet for overhead projector) is held and passed between the heating roller and the backup member. This release layer may be heat resistant resin such as copolymer (PFA) of tetrafluoroethylene and perfluoroalkoxy ethylene, or polytetrafluorethylene (PTFE).

The current transmitting means usually includes the current receiver member electrically connected to the resistance heating member for rotation together with the resistance heating member, and the current supply member being in slidable contact with the current receiver member. Generally, the current receiver member is made of metal such as brass, copper, silver or stainless steel. The current supply member is primarily made of carbon substance such as carbon, carbon graphite, electrical graphite, natural graphite, or metallic graphite containing silver or copper. In the fixing device of the invention, the current receiver member and the current supply member may be made of materials usually used for the current supply member and the current receiver member, respectively. Specifically, the current supply member may be made of electrically conductive metal substance such as brass, copper, silver or stainless steel, and the current receiver member may be made of electrically conductive substance such as carbon substances described above. In this case, the current supply member, which is conventionally made of carbon substance and therefore will be rapidly worn with use, does not require exchange or requires exchange after a long cycle, owing to such a manner that the current receiver member, which is made of carbon substance and therefore is liable to wear, is exchanged simultaneously with exchanging the heating roller. As a result, a time for part exchange of the fixing device can be reduced.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 6 to 9(A) are schematic cross sections of fixing devices of different embodiments of the invention, respectively;

DESCRIPTION OF THE PREFERRED EMBODIMENTS

Embodiments of the invention will be described below with reference to the drawings.

Figure 1:
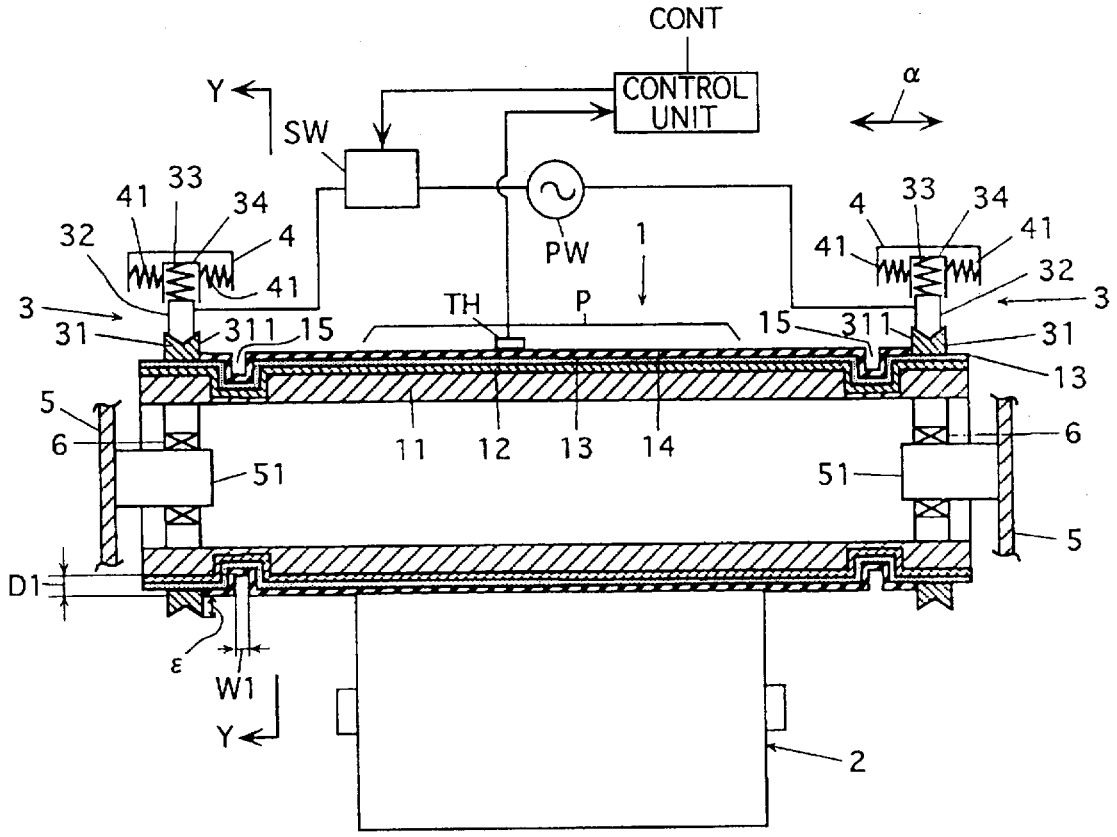
FIG. 1 is a schematic cross section of a fixing device of an embodiment of the invention.

FIG. 1 is a schematic cross section showing a fixing device of an embodiment of the invention, in which a resistance heating member is arranged on an outer peripheral surface of a heating roller. The device shown in FIG. 1 is operable to heat and fix a toner image, i.e., unfixed image to a record paper sheet which is a record member for holding the image.

The fixing device has a heating roller 1 and a pressure roller 2 which is a backup member pressed against the heating roller 1. The heating roller 1 is rotatably carried by bearing units 6 (which will be described later in detail) for the roller 1 and support shafts 51 projected from side plate members 5 of the fixing device. The pressure roller 2 is rotatably carried by carrying means (not shown), and is pressed against the heating roller 1 by pressing means (not shown). The heating roller 1 and the pressure roller 2 are driven in a record sheet feed direction by drive means (not shown).

The heating roller 1 has a hollow and cylindrical core roller 11 made of aluminum. The ring-shaped bearing units 6 including ball bearings are fitted into opposite ends of the core roller 11, respectively. Each bearing unit 6 has an outer peripheral surface fitted into the core roller 11. Each bearing unit 6 has an inner peripheral surface fitted around the support shaft 51. In this manner, the core roller 11 and therefore the heating roller 1 can smoothly rotate around the support shafts 51 owing to the ball bearings of the bearing units 6.

An insulating layer 12 made of polyimide, which is heat-resistant insulating resin, is formed over the outer peripheral surface of the core roller 11, and a resistance heating member 13 in a layer form, which is made of barium titanate ceramics having a positive temperature coefficient of resistance, is formed over the outer peripheral surface of the insulating layer 12. A release layer 14, which is made of heat resistant resin, i.e., polytetrafluorethylene (PTFE), is formed over the outer peripheral surface of the resistance heating member 13. The insulating layer 12, resistance heating member 13 and release layer 14 rotate together with the core roller 11. The release layer 14 has a width (i.e., a length along a rotation axis of the core roller 11) is longer than a maximum width of a record sheet, which passes between the heating roller 1 and the pressure roller 2 and bears a toner image. The resistance heating member 13 has a width larger than the width of the release layer 14 so as to ensure contact of current transmitting units 3, which will be described later, with surfaces of the opposite ends of the heating member 13 and ensure transmission of the current. The insulating layer 12 has a width equal to or larger than the width of the heating member 13 so as to insulate the resistance heating member 13, through which a current flows, and the core roller 11 from each other.

A pair of circular ring-shaped rotary current receiver members 31 are fitted and fixed onto outer peripheries of the opposite ends of the resistance heating member 13 protruding from the release layer 14. The current receiver members 31 are made of electrically conductive copper alloy, and are located at positions opposed to the bearing units 6 with the cylindrical wall of the core roller 11 therebetween, respectively. The current receiver members 31 are electrically connected to the resistance heating member 13. Similarly to the insulating layer 12, resistance heating member 13 and release layer 14, the current receiver members 31 rotate together with the core roller 11. An electrically conductive current supply member 32 made of carbon is pressed against each current receiver member 31 by a spring 33. An electrical contact is ensured between the current receiver member 31 and the current supply member 32 even when the current receiver member 31 rotates together with the core roller 11. Each of the paired current transmitting units 3 is formed of the current receiver member 31 and the current supply member 32, which are in contact with each other, as well as the spring 33. One of the current supply members 32 is electrically connected to a power supply PW via a switch SW and the other current supply member 32 is also electrically connected to the power supply PW. Therefore, the resistance heating member 13 can be electrically connected to the power supply PW.

A thermistor TH which is a temperature sensing element is arranged for a portion of the resistance heating member 13. A temperature sensed by the same is sent to a temperature control unit CONT. The switch SW is operated so that the temperature of the heating roller attains a predetermined temperature based on an instruction from the control unit CONT.

The current transmitting unit including the current receiver member 31 and the current supply member 32 will be described below more in detail. Each current receiver member 31 has a contact surface having a concave section for contact with the current supply member 32. This concave surface continuously and annularly extends. The contact surface of each current supply member 32 for contact with the current receiver member 31 has a convex section complementary to the concave section of the current receiver member 31.

Each current supply member 32 is fitted to a current supply member carrying holder 34, and is pressed against the current receiver member 31 by the spring 33 arranged in the current supply member carrying holder 34.

Each current supply member carrying holder 34 is carried by a holder 4, which is holder carrying means and has two springs 41 therein for allowing motion of the holder 34 in a direction crossing a contact and moving direction of the current supply member 32 with respect to the current receiver member 31.

The direction crossing the above contact and moving direction is parallel to a rotation axis of the core roller 11, and is indicated by an arrow α in FIG. 1.

In each current transmitting unit 3, a surface 321 of the current supply member 32 in contact with the outer peripheral surface of the current receiver member 31 extends in the circumferential direction of the current receiver member 31, and is a curved concave surface. It is assumed that an arc extending in the circumferential direction of the current receiver member through a certain point on the curved concave surface 321 has a curvature radius (radius of curvature) R1, and that an outer periphery circle of the current receiver member 31 extending through the above point has a radius R2. In this case, a relationship of R2<R1 is established.

Figure 2:
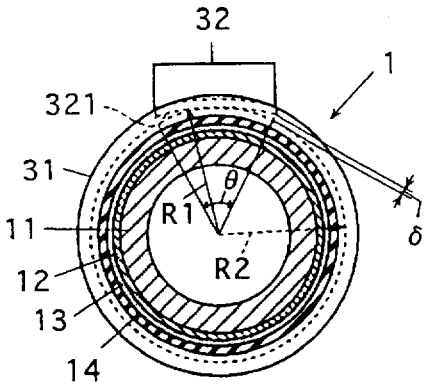
FIG. 2 is a cross section taken along line Y—Y in FIG. 1.

With reference to FIG. 2, description will be given particularly on a top of the convex section of the current supply member 32 (i.e., portion in contact with a bottom of the concave section of the current receiver member 32). The curvature radius R1 of the arc extending through the convex top of the concave surface 321 of the current supply member 32 is 45 mm, and the outer periphery circle of the current receiver member 31 which is in contact with the above arc, i.e., the outer periphery circle extending through the concave bottom of the current receiver member 31 has the radius R2 of 30 mm. Thus, the relationship of R2<R1 is established. The curved concave surface 321 extends over an angle θ of 60°, and in other words, has a diverging angle θ of 60°.

As shown in FIG. 1, the width of the current supply member 32 in the rotation axis direction of the heating roller 1 indicated by the arrow α is smaller than the width of the current receiver member 31 in the same direction.

In the current transmitting unit 3, at least an inner side surface 311 of the current receiver member 31 has an outer periphery circle, of which radius is larger by 10 mm than the radius of the outer periphery circle of the heating roller 1 at the sheet passing region. In other words, the outer periphery circle of the side surface 311 of the current receiver member 31 protrudes radially outward from the outer periphery circle of the sheet passing region of the heating roller 1 with a radially difference ε of 10 mm.

The heating roller 1 will be further described below. The heating roller 1 is provided over its entire circumference with dust movement restricting grooves 15, which are located near and axially inside the current transmitting units 3, respectively. Each groove 15 has a width W1 of 1.5 mm and a depth D1 of 0.8 mm.

According to the fixing device described above, the switch SW is closed in accordance with an instruction sent from the control unit CONT, so that a power is supplied to the resistance heating member 13. The resistance heating member 13 generates Joule-heat, and thereby heats the heating roller 1 to a predetermined fixing temperature. The heating roller temperature is maintained at a predetermined fixing temperature by operating the switch SW in accordance with the instruction from the control unit CONT.

The heating roller 1 which is heated by the resistance heating member 13 has a thermal conversion efficiency and an efficiency of heat conduction from the heat source to the core roller 11, which are higher than those by a conventional heating roller heated by heat radiated from a heater such as a halogen lamp heater. Therefore, the heating roller 1 can perform a cost-effective operation, and can reduce a warming-up time.

The record sheet bearing the toner image is transferred by unillustrated transferring means, and its forward end reaches a nip between the heating roller 1, which is heated to the predetermined fixing temperature, and the pressure roller 2 pressed against the heating roller 1. Since these rollers are rotated by the unillustrated drive means, the record sheet thus transferred is held and passed between these rollers, and the toner image on the record sheet is heated and fixed to the record sheet.

Each current transmitting unit 3 is opposed to the bearing unit 6 with the cylindrical wall of the core roller 11 therebetween. This bearing unit 6 is subjected to the least influence, for example, by eccentric rotation of the heating roller 1 due to a manufacturing error or the like thereof, and bending of the roller 1 due to a high pressure of the pressure roller 2 against the roller 1. Therefore, it is possible to suppress contact failure between the current receiver member 31 and the current supply member 32, and thus a power can be stably supplied to the resistance heating member 13. Owing to the foregoing position, a small pressure of about 100 to 200 g/cm$^2$ is required for the spring 33 pressing the current supply member 32 against the current receiver member 31. Therefore, the slide contact surfaces of the current supply member 32 and the current receiver member 31 wear only to a small extent compared with the conventional case that a current transmitting unit is formed of a bearing itself subjected to a high pressing force of a backup member such as a pressure roller or the like. Therefore, the fixing device can operate stably for a long term.

Figure 13:
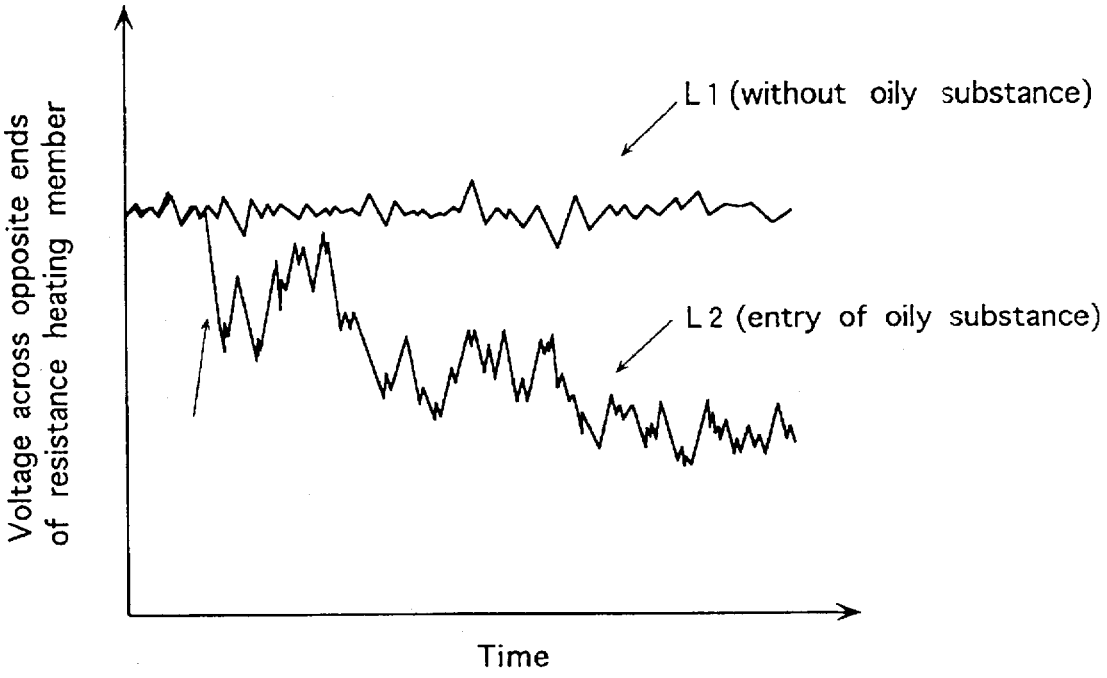
FIG. 13 is a graph showing change in voltage across opposite ends of the resistance heating member with a constant voltage at a power supply connected to a resistance heating member.
Figure 14:
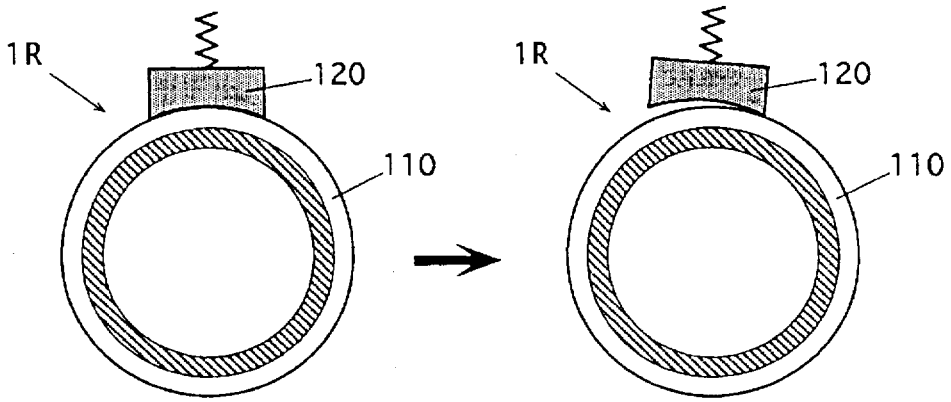
Fig.14 (PRIOR ART)
FIG. 14 shows a contact state of a current supply member and a current receiver member in a conventional fixing device, which is found when separation occurs.

The current transmitting units 3 are provided independently from the bearing units 6, i.e., rotary carrying means for the heating roller 1, and are opposed to the bearing units 6 with the cylindrical wall of the core roller 11 therebetween, respectively. Therefore, there is no possibility that oil substance or the like at the bearing units 6 enter the current transmitting units 3, and the voltage at the resistance heating member does not substantially change as indicated by a graph L1 in FIG. 13. Therefore, a heat generating current can be stably supplied to the resistance heating member 13 via the current transmitting units 3. Further, a current does not flow through each bearing unit 6. Therefore, it is not necessary to provide electrical conductivity at the bearing units 6 and oil lubricant at the bearing units 6, so that they can be inexpensive. Further, a problem of heating by current flow through the bearing unit 6 does not occur, so that it is not necessary to provide heat resistance at the bearing unit 6 and the oil substance, and thus they can be further inexpensive.

According to the fixing device in FIG. 1, the following advantage can also be achieved. In the operation of applying a voltage to the resistance heating member 13, a lateral shift or the like may occur between the current supply member 32 and the current receiver member 31. Even in this case, they are brought into contact with each other owing to the convex section of the current supply member 32 and the concave section of the current receiver member 31 fitted thereto. Therefore, it is possible to suppress relative movement or shift between the slide contact surfaces for voltage application from the current supply member 32 to the current receiver member 31, so that the power can be supplied stably to the resistance heating member 13.

This fixing device can further achieve the following advantage. Even when the current receiver member 31 shifts laterally, i.e., in the direction of the rotation axis of the core roller 1, the current supply member 32 can follow this shift or lateral movement owing to the holder 4 carrying the current supply member carrying holder 34 and the springs 41. Therefore, it is possible to suppress relative movement or shift between the slide contact surfaces provided for voltage application between the current supply member 32 and the current receiver member 31, so that the power can be supplied stably to the resistance heating member 13.

Since the current supply member 32 and the current receiver member 31 are provided with convex and concave surfaces, respectively, the contact area between these members is larger than that in the structure where both the members have flat contact surfaces. Therefore, the electrical contact resistance can be small, and heating at the current supply member 32 and the current receiver member 31 is suppressed, so that it is possible to suppress power transmission failure due to degradation of these members by heat generation.

If the heat value is equal to that in the conventional structure, i.e., if the contact area between the supply and receiver members 32 and 31 is equal to that in the conventional structure and therefore the contact resistance between them is equal to that in the conventional structure, the current supply member 32 and the current receiver member 31 can be smaller in size than those in the conventional structure, so that the fixing device can be entirely reduced in size. In other words, even in the structure where the current receiver member and the current supply member of small sizes are employed for reducing whole sizes of the fixing device, the contact area between these members can be larger than that in the conventional structure, so that heat generation due to the electrical contact resistance between these members can be suppressed.

The current receiver member 31 and the current supply member 32 may have the mutual contact surfaces of the shapes other than the concave and convex shapes shown in FIG. 1, and for example, may have the contact surfaces of shapes of which sections are shown in FIGS. 3(A) to 3(E). FIGS. 3(A) to 3(E) are schematic cross sections showing sections of the mutual contact surfaces of the current receiver member and the current supply member. Each of the members in each of FIGS. 3(A) to 3(E) is not restricted to the current receiver member or the current supply member. One of them may be either the current receiver member or the current supply member.

Figure 3A:
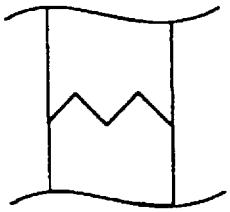
FIGS. 3(A) to 3(G) show different examples of contact surfaces of a current receiver member and a current supply member, respectively.
Figure 3B:
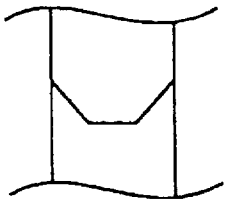
Figure 3C:
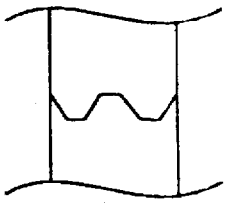
Figure 3D:
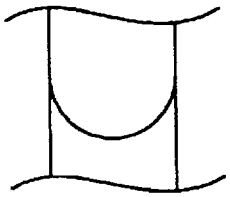
Figure 3E:
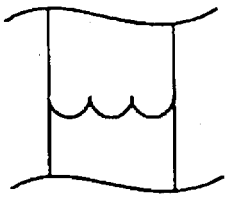
Figure 3F:
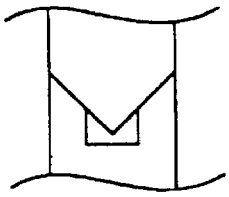
Figure 3G:
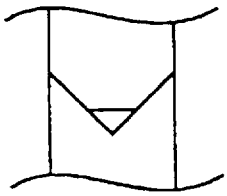

As shown in FIGS. 3(F) and 3(G), one or both of the top of the convex section or the corresponding bottom of the concave section may be recessed. This provides a space at a recessed portion, and thus allows smooth contact between both the surfaces.

Figure 4:
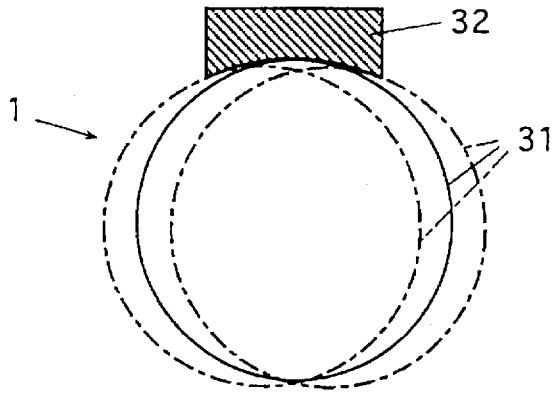
FIG. 4 shows a state of contact of the current receiver member with the current supply member in the state that a heating roller radially vibrates in the fixing device in FIG. 1.

In the fixing device shown in FIG. 1, each current supply member 32 has the curved concave contact surface which is in contact with the outer peripheral surface of the current receiver member 31, and the arc extending through one point on the curved concave surface of the current supply member 32 has the curvature radius R1 which satisfies the relationship of R2<R1 where R2 is the radius of the outer periphery circle of the current receiver member 31 which is in contact with the arc. Therefore, a region at which the current receiver member 31 and the current supply member 32 can be in contact with each other is present along the peripheral surface of the current receiver member 31. Thereby, even when radial vibration or bound of the heating roller 1 itself occurs, the current receiver member 31 and the current supply member 32 are kept in contact with each other through at least a circumferential portion of the current receiver member 31, and this contact portion can vary in response to a direction of stress application along the periphery of the current receiver member 31 as shown in FIG. 4.

Figure 5:
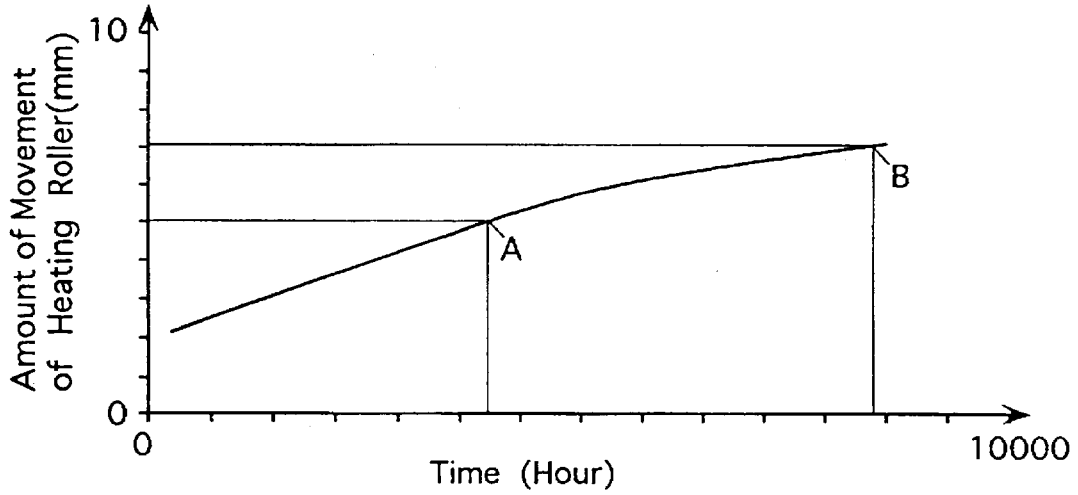
FIG. 5 shows an amount of movement of the heating roller with time, a position A of separation between a current supply member and a current receiver member in the case where the current supply member and the current receiver member have contact surfaces of equal curvature radii, and a position B of separation between a current supply member and a current receiver member in the case where the current supply member and the current receiver member of the invention are employed.

Thereby, even when the radial vibration or bound of the heating roller 1 itself occurs, insufficient contact between the current receiver member 31 and the current supply member 32 is prevented. Therefore, as shown in FIG. 5, separation of these members can be suppressed to a higher extent even if the heating roller 1 shifts or moves to a higher extent, compared with the case where the current receiver member and the current supply member have contact surfaces of the equal curvature radii (separation of both the members at a point A in FIG. 5). Thereby, electric noises and separation can be suppressed. Since an appropriate stress is always applied only to the contact portion, it is possible to prevent breakage of the current supply member 32 and others due to an excessive load against portions other than the contact portion.

The curvature radius R1 of the arc extending through the top of the convex shape of the curved concave surface of the current supply member 32, a diverging angle θ of the current supply member 32, and the radius R2 of the outer periphery circle extending through the bottom of the concave surface of the current receiver member 31 are not restricted to the above described values (i.e., R1=45 mm, θ=60°, and R2=30 mm). For example, values of R1, R2 and θ can be appropriately selected as shown in table 1 for effectively preventing electrical noises and separation of the current supply member and current receiver member, and combinations of these values can be selected in view of the required performance, sizes and others of the fixing device as well as the required performance, sizes and others of a copying machine or the like including this fixing device.

The table 1 represents results of a test or experiment which was performed for determining an effect of preventing electrical noises and separation of the current supply member and current receiver member with various values of R1, R2 and θ in the device shown in FIG. 1.

In the table 1, δ means a distance between the members, which is the distance between an end of the current supply member 32 and the current receiver member 31 in the state that a center of the curved concave surface of the current supply member 32 is in contact with the outer peripheral surface of the current receiver member 31 (see FIG. 2). In the column of "Effect", circular marks represent that effect was found, and triangular marks represent that significant effect was not found.

From the table 1, it can be understood that combination of the current supply member 32 and the current receiver member 31 spaced by the distance δ of about 2 mm or less can effectively prevent electrical noises and separation of these members.

TABLE 1

| R2 (mm) | R1 (mm) | θ | δ(mm) | Effect |
|---|---|---|---|---|
| 30 | 45 | 60 | 1.4 | O |
| 30 | 45 | 120 | 5.5 | Δ |
| 30 | 60 | 60 | 2.1 | O |
| 30 | 60 | 120 | 9.0 | Δ |
| 20 | 30 | 60 | 0.9 | O |
| 20 | 30 | 120 | 3.7 | Δ |
| 20 | 40 | 60 | 1.4 | O |
| 20 | 40 | 120 | 6.0 | Δ |
| 10 | 15 | 60 | 0.5 | O |

TABLE 1-continued

| R2 (mm) | R1 (mm) | θ | δ(mm) | Effect |
|---|---|---|---|---|
| 10 | 15 | 120 | 1.8 | O |
| 10 | 20 | 60 | 0.7 | O |
| 10 | 20 | 120 | 3.0 | Δ |

In the assembly process of attaching the heating roller 1 to the fixing device body, a positional relationship between the heating roller 1 and the current supply member 32 can be easily and reliably adjusted and thus assembly of the fixing device can be performed easily and reliably, because the contact surfaces of the current receiver member 31 and the current supply member 32 maintain the relationship R2<R1, i.e., the relationship with a margin.

Further, the width of the current supply member 32 in the direction of the rotation axis of the heating roller 1 (direction α in FIG. 1) is smaller than the width of the current receiver member 31 in the same direction. Therefore, even when the heating roller 1 shifts in the direction of the rotation axis, it is possible to prevent the current supply member 32 from disengaging from the current receiver member 31, and thus stable contact can be achieved between these members. In this case, it is desired that the current supply member 32 is in contact with a central area in the width direction of the current receiver member 31.

The current supply member 32 may be made of a material harder than the current receiver member 31. For example, the current receiver member 31 may be made of copper-contained graphite material, and the current supply member 32 may be made of brass which is harder than the copper-containing graphite material of the current receiver member. In this case, the current receiver member, which is made of a carbon-contained material and therefore will rapidly wear with use, will be replaced simultaneously with the heating roller, which is provided with the release layer shaved by the record sheets passing over the same and therefore must be periodically exchanged with new one. Thereby, it is not necessary to exchange the current supply member which is made of a material harder than the current receiver member, or exchange of the current supply member, if necessary, can be performed with a long cycle. Therefore, a time required for exchange of parts of the fixing device can be reduced.

According to the fixing device shown in FIG. 1, the heating roller 1 is provided with the dust movement restricting grooves 15. Only by this simple mechanism or means, it is possible to prevent or sufficiently suppress movement of wear powder, which is produced by slide contact between the current supply member 32 and the current receiver member 31, to the sheet passing region P, and movement of toner powder and paper powder generated at the sheet passing region P to the current transmitting units 3. This suppresses operation failure of the fixing device and lowering of the image quality of the fixed image.

In each current transmitting unit 3, at least the outer periphery circle of the inner side surface of the current receiver member 31 has a radial difference of 10 mm with respect to the outer periphery circle of the sheet passing region P of the heating roller 1. This also suppresses movement or the like of the toner powder, paper powder and others to the current transmitting unit 3.

Figure 6:
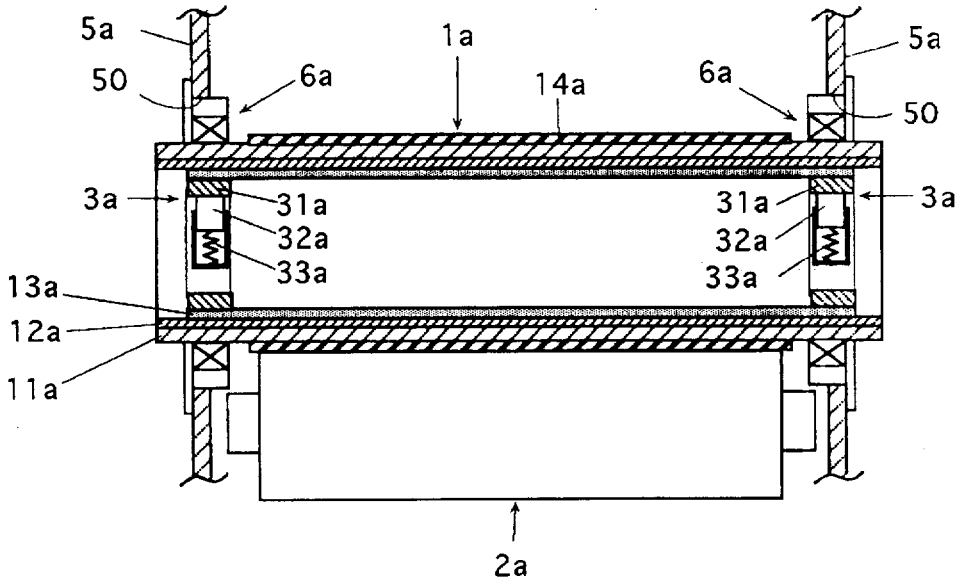

A fixing device of another embodiment of the invention will be described below with reference to FIG. 6.

This fixing device has a heating roller 1*a* and a pressure roller 2*a* which is a backup member pressed against the heating roller 1*a*. The heating roller 1*a* is rotatably carried in the following manner. Each of side plate members 5*a* of the fixing device is provided with a circular hole 50, into which a ball bearing unit 6*a* is fitted. A bearing unit 6*a* is also fitted to a core roller 11*a* (to be described later). Opposite ends of the outer peripheral surface of the roller 11*a* are carried by the bearing units 6*a*. In this manner, the heating roller 1*a* is rotatably carried.

The pressure roller 2*a* is carried by carrying means (not shown), and is pressed against the heating roller 1*a* by pressing means (not shown). The heating roller 1*a* and the pressure roller 2*a* are driven to rotate by drive means (not shown).

The heating roller 1*a* has a hollow and cylindrical core roller made of aluminum. A release layer 14*a* is formed over the outer peripheral surface of the core roller 11*a*. An insulating layer 12*a* is formed over the inner peripheral surface of the core roller 11*a*, and a resistance heating member 13*a* in a layer form is formed over the inner peripheral surface of the insulating layer 12*a*. The release layer 14*a*, insulating layer 12*a* and resistance heating member 13*a* rotate together with the core roller 11*a*. The release layer 14*a*, insulating layer 12*a* and resistance heating member 13*a* are made of the same materials as those in the fixing device shown in FIG. 1.

A width of the release layer 14*a* is equal to or larger than the maximum width of the record paper sheet bearing an unfixed toner image and passing between the heating roller 1*a* and the pressure roller 2*a*. The insulating layer 12*a* has a width wider than the width of the resistance heating member 13*a* for insulating the resistance heating member 13*a*, through which a current flows, from the core roller 11*a*.

On the inner peripheral surfaces of the opposite ends of the resistance heating member 13*a*, and particularly at positions opposed to the bearing units 6*a* with the cylindrical wall of the core roller 11*a* therebetween, there are fitted and fixed a pair of ring-like current receiver members 31*a* made of electrically conductive copper alloy. Therefore, the current receiver member 31*a* is electrically connected to the resistance heating member 13*a*. In addition to the insulating layer 12*a*, resistance heating member 13*a* and release layer 14*a*, the current receiver members 31*a* also rotate together with the core roller 11*a*. Against each current receiver member 31*a* is pressed an electrically conductive current supply member 32*a* made of carbon by springs 33*a*. The current receiver member 31*a* and the current supply member 32*a* are adapted to maintain electrical connection between them even when the current receiver member 31*a* rotates together with the core roller 11*a*. These paired current receiver members 31*a*, current supply members 32*a* and springs 33*a* form a pair of current transmitting units 3*a*. Although not shown, a power is supplied to the resistance heating member 13*a* in accordance with instructions from a control unit similar to that in the fixing device shown in FIG. 1.

According to this fixing device, the toner image is heated and fixed to the record paper sheet bearing the toner image similarly to the fixing device shown in FIG. 1.

Similarly to the fixing device shown in FIG. 1, the current transmitting units 3*a* are located at the positions opposed to the bearing units 6*a* with the cylindrical wall of the core roller 11*a* therebetween, and these bearing units 6*a* are least subjected to the influence by eccentric rotation of the heating roller 1*a* due to a roller manufacturing error or the like and bending of the roller 1*a* due to the high pressure between the heating and pressure rollers 1*a* and 2*a*. Further, the current transmitting unit 3a is arranged independently from the bearing unit 6a which is a rotary support unit for the heating roller 1a. Therefore, this embodiment can provide an effect similar to that by such arrangement that the current transmitting unit 3 is opposed to the heating roller bearing unit 6 in the fixing device shown in FIG. 1.

Two fixing devices of still another embodiments of the invention will be described below with reference to FIGS. 7 and 8.

Figure 7:
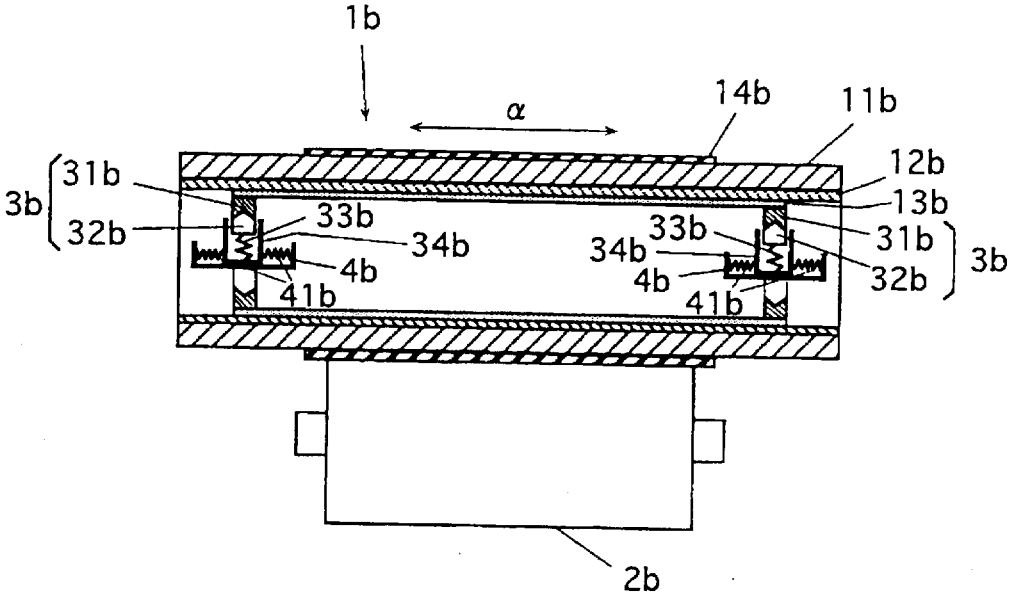
Figure 8:
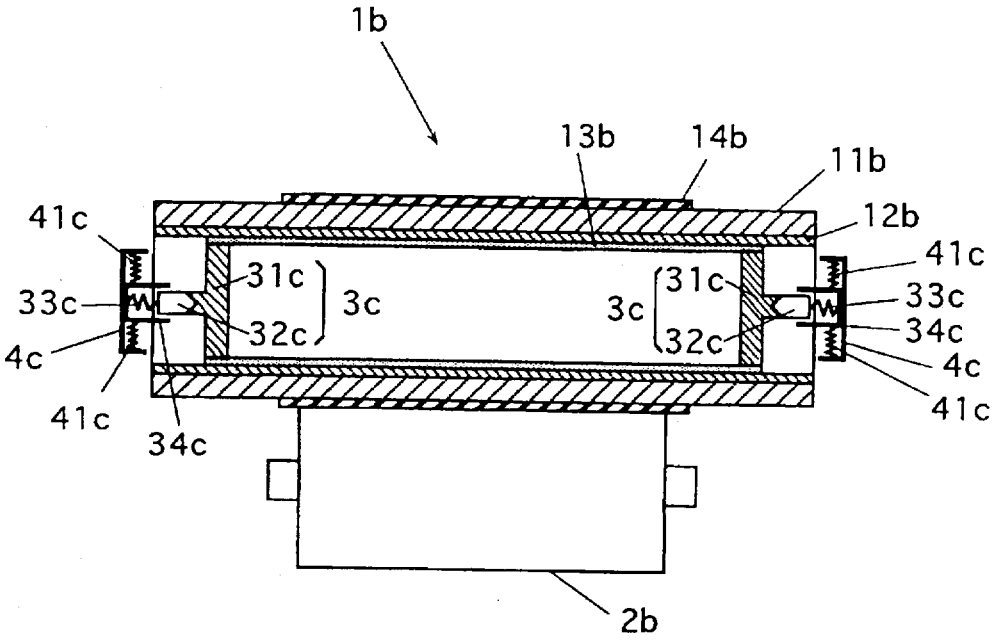

Each of the fixing devices shown in FIGS. 7 and 8 includes a heating roller 1b and a pressure roller 2b pressed against the heating roller 1b by pressing means (not shown). The heating roller 1b and the pressure roller 2b are rotatably carried by the carrying means (not shown). The heating roller 1b has a cylindrical core roller 11b made of aluminum. A release layer 14b is formed over the outer peripheral surface of the core roller 11b, and an electrically insulating layer 12b is formed over the inner peripheral surface of the core roller 11b. Further, a resistance heating member 13b is formed over the inner peripheral surface of the electrically insulating layer 12b. The resistance heating member 13b, release layer 14b and electrically insulating layer 12b are made of the same materials as those in the fixing device shown in FIG. 1.

In the fixing device shown in FIG. 7, current transmitting units 3b are arranged inside the opposite ends of the core roller 11b.

More specifically, a circular ring-like current receiver member 31b is arranged at each end portion of the core roller 11b, and is fitted and fixed to the inner peripheral surface of the resistance heating member 13b. The current supply member 32b is in slidable contact with the current receiver member 31b. Each current supply member 32b is fitted to a current supply member carrying holder 34b, and is brought into contact with the current receiver member 31b by a spring 33b in the holder. Each current supply member 32b has a convex contact surface which is in contact with the current receiver member 31b, which has a concave contact surface complementary to it.

The holders 4b carry the current supply member carrying holders 34b for motion of the members 32b in the direction of the rotation axis of the core roller 11b (i.e., direction α in FIG. 7) owing to the holders 4b and the springs 41b therein. Therefore, it is possible to suppress relative shift or movement between the contact surfaces for current transmission of the current supply members 32b and the current receiver members 31b. Also, these members can have a relatively large contact area compared with their entire sizes, and thus can reduce a contact resistance. Therefore, heat generation due to the electrical contact resistance can be suppressed even with the current transmitting unit of a compact structure, and thus the power can be stably transmitted to the resistance heating member 13b.

In the fixing device shown in FIG. 8, current transmitting units 3c are arranged inside opposite ends of core roller 11b. Thus, circular plate-like current receiver members 31c are fitted and fixed to opposite ends of an inner peripheral surface of resistance heating member 13b. Each current receiver member 31c has a concave contact surface which is in contact with a current supply member 32c. The current receiver member 31c rotates together with the core roller 11b.

The current supply members 32c are arranged at axially outer positions, i.e., outer positions in the direction of the rotation axis of the core roller 11b, with respect to these current receiver members 31c, and have convex surfaces complementary to the concave surfaces of the current receiver member 31c, respectively. Each current supply member 32c is fitted to a current supply member supporting holder 34c, and is pressed against the current receiver member 31c by a spring 33c in the current supply member carrying holder 34c.

Each current supply member carrying holder 34c is carried by carrying means, i.e., holder 4c and four springs 41c in the holder 4c, and is movable in a direction crossing the contact and moving direction of the current supply member 32c with respect to the current receiver member 31c. More specifically, each holder 4c in this embodiment has a circular cup-like form. The current supply member carrying holder 34c is arranged at the center of the holder 4c, and is radially carried by the springs 41c in the holder 4c which are angularly spaced by 90° from each other. In this manner, the current supply member 32c is carried and movable in the direction crossing the contact and moving direction of the current supply member 32c with respect to the current receiver member 31c. This direction crossing the contact and moving direction is substantially perpendicular to the rotation axis of the core roller 11b.

In this embodiment, the current supply member 32c has a convex surface, and the current receiver member 31c has a concave surface similarly to the embodiments already described. Also, the holder 4c and the springs 41c carry the current supply member carrying holder 34c for motion in a plane substantially perpendicular to the rotation axis of the core roller 11b. Therefore, it is possible to suppress relative movement of the contact surfaces for current transmission of the current supply member 32c and current receiver member 31c. Further, these members can be in contact with each other through a relatively large contact area and thus with a relatively small contact resistance compared with their whole sizes. Therefore, the current transmitting unit can have a compact structure, and heating due to the contact resistance is suppressed, which further stabilizes the power transmission to the resistance heating member 13b.

In the device shown in FIGS. 7 and 8, the current receiver member and current supply member may have contact surfaces of sections other than the concave and convex sections shown in FIGS. 7 and 8, and specifically, may have sections shown in FIGS. 3(A) to 3(G). Each of the current receiver member 31c and the current supply member 32c shown in FIG. 8 may have a plurality of convex or concave surface portions, which are concentric with each other.

In the fixing devices shown in FIGS. 7 and 8, the power is transmitted to the resistance heating member 13b in a manner similar to that of the device shown in FIG. 1.

A fixing device of still another embodiment of the invention will be described below with reference to FIGS. 9(A) to 9(C).

Figure 9A:
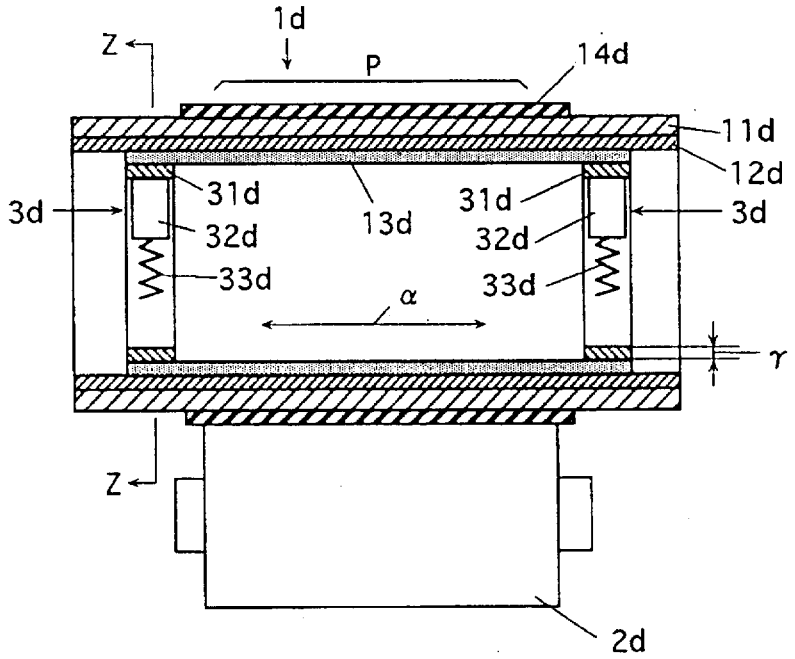
Figure 9B:
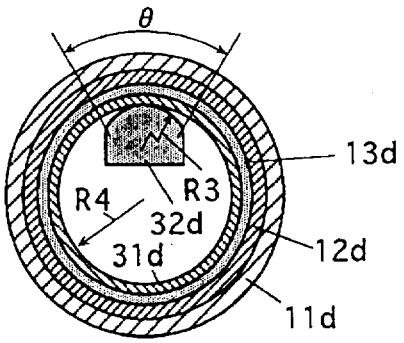
FIG. 9(B) is a cross section taken along line Z—Z in FIG. 9(A)
Figure 9C:
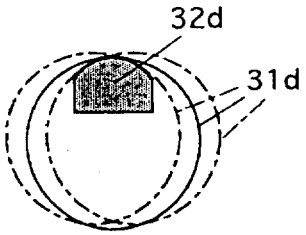
FIG. 9(C) shows a state of contact of the current receiver member with the current supply member in the state that a heating roller vibrates in the fixing device in FIG. 9(A)

Similarly to the fixing device shown in FIG. 1, the fixing device shown in FIGS. 9(A) to 9(C) is operable to heat and fix an unfixed image, i.e., toner image onto a record paper sheet, i.e., record member bearing the toner image.

This fixing device has a heating roller 1d and a pressure roller 2d which is pressed against the roller 1d by pressing means (not shown). The heating roller 1d and pressure roller 2d are rotatably carried by carrying means (not shown), and are driven to rotate by drive means (not shown).

The heating roller 1d has a hollow cylindrical core roller 11d made of aluminum. A release layer 14d is formed over the outer peripheral surface of the core roller 11d, and an electrically insulating layer 12d and a resistance heating member 13d are layered over the inner peripheral surface of the core roller 11d.

The release layer 14*d*, resistance heating member 13*d* and electrically insulating layer 12*d* are made of the same materials as those in the fixing device shown in FIG. 1. The resistance heating member 13*d*, release layer 14*d* and electrically insulating layer 12*d* rotate together with the core roller 11*d*.

Current transmitting units 3*d* are arranged radially inside the opposite ends of the resistance heating member 13*d*, respectively. More specifically, a pair of ring-like current receiver members 31*d*, which are electrically conductive and are made of copper contained graphite materials, are fitted and fixed to the opposite ends of the resistance heating member 13*d*. The current receiver member 31*d* has an inner diameter R4 of 28 mm. The current receiver members 31*d* rotate together with the core roller 11*d*.

As shown in FIG. 9(B), electrically conductive current supply members 32*d* having arc-shaped convex surfaces, which extend along and are in contact with the inner peripheral surfaces of the current receiver members 31*d*, are arranged on the inner peripheral surfaces of the current receiver members 31*d*, respectively. The curvature radius (radius of curvature) R3 of the curved convex surface, and, in the strict sense, the curvature radius R3 of the arc at the curved convex surface in the circumferential direction of the current receiver member is 16 mm, and the diverging angle θ is 90°. In FIG. 9(A), a width of the current supply member 32*d* in the direction of the rotation axis of the heating roller 1*d* indicated by an arrow α is smaller than that of the current receiver member 31*d* in the same direction. The current supply member 32*d* is made of brass harder than the current receiver member 31*d* made of copper contained graphite, and is pressed against the current receiver member 31*d* by a spring 33*d* which is pressing means, so that electrical connection is maintained between the contact surfaces of these members even when the current receiver member 31*d* rotates together with the core roller 11*d*.

In the fixing device shown in FIG. 9(A), the power is transmitted to the resistance heating member 13*d* similarly to the device in FIG. 1.

In this fixing device, the current supply member 32*d* in each current transmitting unit 3*d* has a curved convex surface to be in contact with the inner peripheral surface of the current receiver member 31*d*, and the curvature radius R3 of the curved convex surface of the current supply member 32*d* and the curvature radius R4 of the inner periphery circle of the current receiver member 31*d* satisfy the relationship of R3<R4. Therefore, the mutual contact region between the current receiver member 31*d* and the current supply member 32*d* is present along the circumferential surface of the current receiver member 31*d*. Consequently, even when radial vibration or bound of the heating roller 1 itself occurs, the contact position can move in response to a direction of stress application along the circumference of the current receiver member 31*d* while maintaining such a state that the current receiver member 31*d* and the current supply member 32*d* are in contact with each other through at least one circumferential portion of the current receiver member 31*d*, as shown in FIG. 9(C).

Therefore, even when radial vibration or bound of the heating roller 1*d* itself occurs, contact failure does not occur between the current receiver member 31*d* and the current supply member 32*d*, so that electrical noises and separation of the supply and receiver members can be prevented. Since an appropriate stress is continuously applied only to the contact portion, it is possible to prevent breakage of the current supply member 32*d* due to an excessive load on the other portion.

In this fixing device, the curvature radius R3 of the curved convex surface of the current supply member 32*d*, the diverging angle θ of the current supply member 32*d* and the radius R4 of the inner periphery circle of the current receiver member 31*d* are not restricted to the values described above (i.e., R3=16 mm, θ=90°, R4=28 mm). As already described in connection with the fixing device shown in FIG. 1, the values of R3, R4 and θ may be appropriately selected for effectively preventing electrical noises and separation of the current supply member and current receiver member, and combinations of these values can be selected in view of the required performance, sizes and others of the fixing device as well as the required performance, sizes and others of a copying machine or the like including this fixing device.

In the assembly process of attaching the heating roller 1*d* to the fixing device body, a positional relationship between the heating roller 1*d* and the current supply member 32*d* can be easily and reliably adjusted and thus assembly of the fixing device can be performed easily and reliably, because the contact surfaces of the current receiver member 31*d* and current supply member 32*d* maintain the relationship of R3<R4, i.e., the relationship with a margin.

Further, the width of the current supply member 32*d* in the direction of the rotation axis of the heating roller 1*d* (direction α in FIG. 9(A)) is smaller than the width of the current receiver member 31*d* in the same direction. Therefore, even when vibration or swing occurs in the direction of the rotation axis of the heating roller 1*d*, it is possible to prevent the current supply member 32*d* from disengaging from the current receiver member 31*d*, and thus stable contact can be achieved between these members. In this case, it is desired that the current supply member 32*d* is in contact with a central area in the width direction of the current receiver member 31*d*.

Since the current receiver member 31*d* is made of copper-contained graphite, and the current supply member 32*d* is made of brass, it is not necessary to exchange the current supply member 32*d*, or exchange thereof, if necessary, can be performed with a long cycle. Therefore, a time required for exchange of parts of the fixing device can be reduced.

In the fixing device in FIG. 9(A), the radius of the inner periphery circle of each current receiver member 31*d* is smaller by 6 mm or more than the radius of the inner periphery circle of the sheet passing region P of the heating roller 1*d*. In other words, the inner periphery circle of each current receiver member 31*d* has a radial difference of 6 mm or more with respect to the inner periphery circle of the sheet passing region P of the heating roller. Therefore, it is possible to suppress toner powder, paper powder, oil in the roller carrying meansn or the like from moving through the inner peripheral surface of the heating roller 1*d* to the contact surfaces of the current receiver member 31*d* and current supply member 32*d*, so that power transmission failure at the current transmitting unit 3*d* can be suppressed.

A fixing device of further another embodiment of the invention will be described below with reference to FIG. 10. This fixing device is operable to heat and fix a toner image to a record member bearing the toner image. This fixing device includes a heating roller 1*e* and a pressure roller 2*e* pressed against the roller 1*e*. The heating roller 1*e* is rotatably carried at a housing 5*e* of the fixing device by heating roller carrying units 6*e*, which includes bearings 60 fitted to the opposite ends (bearing seat ends) of a core roller 11*e* to be described later. The pressure roller 2*e* is rotatably carried by carrying means (not shown), and is driven to rotate together with the heating roller 1*e* by drive means (not shown).

The heating roller 1e has the hollow cylindrical core roller 11e made of aluminum. The core roller 11e is provided at outer peripheral surfaces of its opposite ends with grooves 100, which are located axially outside the heating roller carrying units 6e and extend over the outer periphery of the core roller 11e. An electrically insulating layer 12e, a resistance heating member 13e in a layer form and a release layer 14e are layered over and along the outer peripheral surface of the core roller 11e provided with the grooves 100. The electrically insulating layer 12e and the resistance heating member 13e extend fully between the opposite ends of the core roller 11e, i.e., over the entire width (length in the rotation axis direction of the core roller 11e) of the core roller 11e. The release layer 14e is formed over an area between inner side surfaces of the current receiver members 31e, which are arranged at the opposite ends of the core roller 11e and will be described later. As a result, the heating roller 1e is provided at its outer peripheral surface with dust movement suppressing grooves (dust mevement restricting grooves) 101 extending over its outer periphery. Each groove 101 has a width W2 of 1.5 mm and a depth D2 of 0.8 mm.

The release layer 14e is made of heat resistant resin, i.e., polytetrafluorethylene (PTFE) having release characteristics.

The resistance heating member 13e is made of barium titanate ceramics, and performs Joule-heating when a current flows therethrough.

The electrically insulating layer 12e is arranged between the resistance heating member 13e and the core roller 11e for electrically insulating them from each other, and is made of heat resistant insulating resin and specifically polyimide. The resistance heating member 13e, release layer 14e and electrically insulating layer 12e rotate together with the core roller 11e.

At a position axially outside each dust movement suppressing groove 101 and on the outer periphery of the resistance heating member 13e, there is arranged an electrically conductive ring-like current receiver member 31e which is made of copper alloy and is fixed to the resistance heating member 13e. The current receiver member 31e rotates together with the core roller 11e.

A pair of conductive current supply members 32e made of carbon are arranged in contact with the outer peripheral surfaces of the current receiver members 31e, respectively. These current receiver members 31e and current supply members 32e form current transmitting units 3e, respectively. Each current supply member 32e is pressed against the current receiver member 31e by spring 33e so as to keep electrical connection between their contact surfaces when the current receiver members 31 rotate together with the core roller 11e. A power is transmitted to the resistance heating member 13e in a manner similar to that of the fixing device in FIG. 1.

According to this fixing device, it is possible to prevent or sufficiently suppress by a simple structure, i.e., provision of the dust movement restricting grooves 101, movement of wear powder due to slide contact between the current supply member 32e and the current receiver member 31e to the heating roller bearings 60 and therefore to the sheet passing region P, movement of toner powder and paper powder generated at the sheet passing region P to the current transmitting units 3e, and movement of oil at the heating roller bearings 60 to the current transmitting units 3e. Thereby, it is possible to prevent operation failure of the fixing device and lowering of the image quality of the fixed image.

Each groove 101 has a width W2 and a depth D2 of values selected from combinations of values of a width W and a depth D, which are determined by an experiment and specifically does not lower a voltage across opposite ends of the resistance heating member 13e due to dust when a voltage is applied to the resistance heating member 13e while keeping a constant voltage at a power supply (not shown). In this experiment, a fixing device of the type shown in FIG. 10 but having the heating roller 1e of a diameter of 20 mm was employed, a power supply voltage was maintained constant, the heating roller was operated at a rotation speed of 100 rpm for 1000 hours, and the voltage across the opposite ends of the resistance heating member 13e was measured. The results are shown in the following table 2. In the table 2, values such as "40%" represents the fact that the voltage across opposite ends of the resistance heating member 13e lowered 40% from the power supply voltage, and in other words, the fact that the voltage across the opposite ends of the resistance heating member 13e lowered to 60% of the power supply voltage.

TABLE 2

| | Width W (mm) | | | |
|---|---|---|---|---|
| Depth D (mm) | 0.5 | 1.0 | 1.5 | 2.0 |
| 0.2 | 50% | 40% | 40% | 10% |
| 0.4 | 40% | 20% | 20% | 10% |
| 0.6 | 10% | 0% | 0% | 0% |
| 0.8 | 10% | 0% | 0% | 0% |
| 1.0 | 10% | 0% | 0% | 0% |

It is assumed that lowering by 20% or less of the voltage across the opposite ends of the resistance heating member is allowed. Based on this, it is understood from the table 2 that movement of the toner powder, paper powder, oil or the like to the current transmitting unit can be sufficiently suppressed when the groove has the depth D of 0.4 mm or more and the width W of 1.0 mm or more. It is also understood that the groove depth D of 0.6 mm or more and the groove width W of 1.0 mm or more are more preferable. Accordingly, this embodiment employs the groove depth D2 of 0.8 mm and the groove width W2 of 1.5 mm.

The experimental values described above may vary slightly under different experiment conditions, but are considered to be generally appropriate values.

The width W1 and depth D1 of the dust movement suppressing groove 15 of the heating roller 1 in the fixing device shown in FIG. 1 are determined based on a similar viewpoint.

A fixing device of a further embodiment of the invention will be described below.

Figure 10:
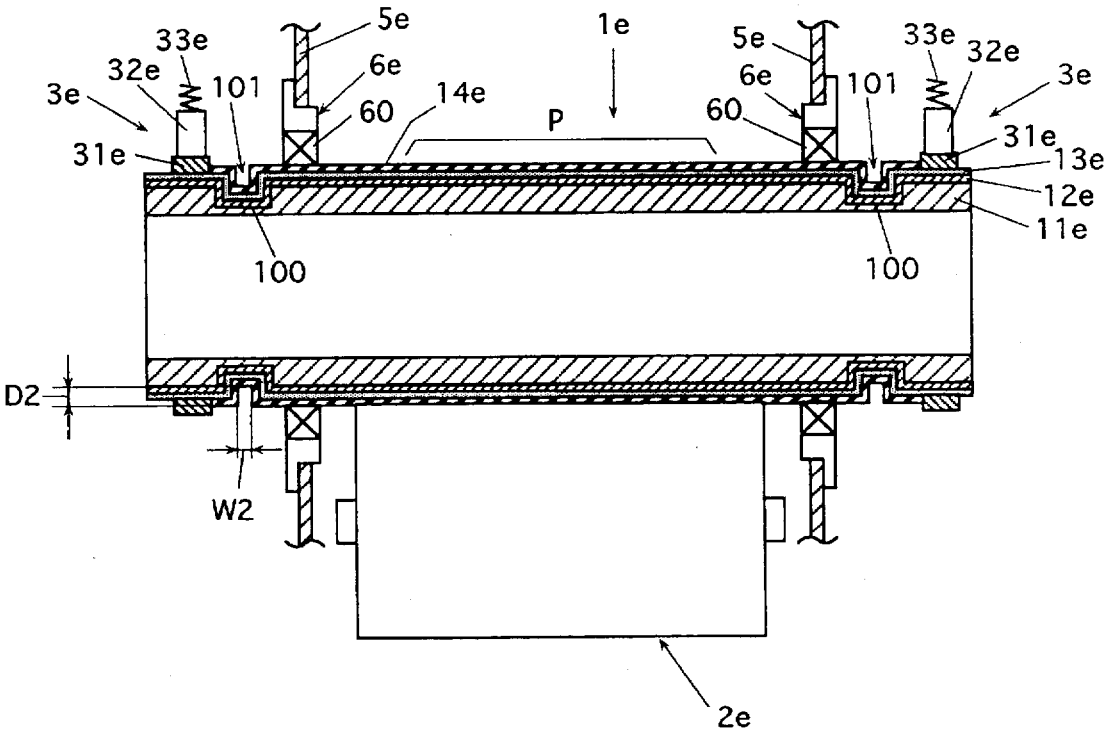
FIGS. 10 to 12 are schematic cross sections of fixing devices of further different embodiments of the invention, respectively.
Figure 11:
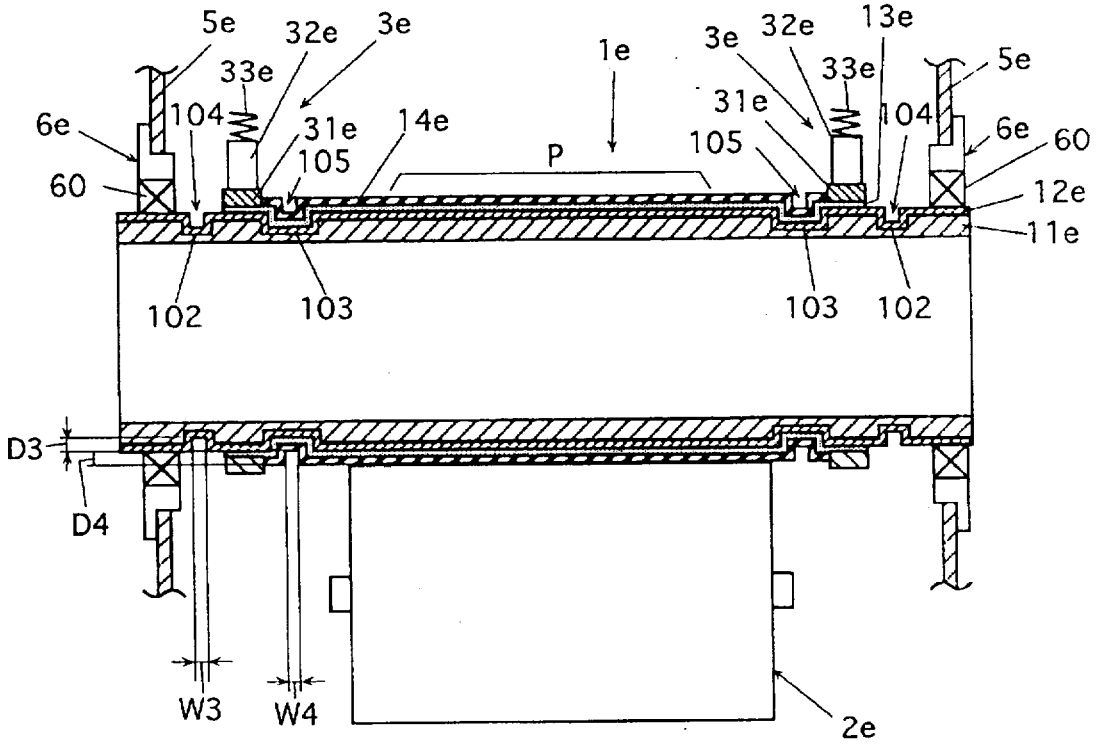

The fixing device shown in FIG. 11 is operable to heat and fix a toner image to a record paper sheet bearing the toner image, similarly to the fixing device shown in FIG. 10. FIG. 11 is a schematic cross section of the device. Parts of the fixing device shown in FIG. 11 which have the substantially same structures and operations as those of the parts in the device shown in FIG. 10 bear the same reference numbers as those in FIG. 10.

Similarly to the foregoing embodiments, the fixing device of this embodiment has the heating roller 1e and the pressure roller 2e pressed thereto by the pressing means (not shown).

The heating roller 1e is rotatably carried at the housing 5e of the fixing device by the heating roller carrying units 6e, similarly to the fixing device shown in FIG. 10. In this device, the heating roller carrying units 6e carry the roller 1e at the outermost positions in the axial direction of the heating roller 1e with respect to the current receiver members 31e and sheet passing region P. The pressure roller 2e is rotatably carried by the carrying means (not shown), and is driven to rotate together with the heating roller 1e by drive means (not shown).

The heating roller 1e has a hollow cylindrical core roller 11e. Grooves 102 extending over the outer periphery of the core roller 1e are formed axially inside the heating roller carrying units 6e carrying the outer peripheral surfaces of the opposite ends of the core roller 11e. Further, the core roller 11e is provided at positions axially inside the grooves 102 with grooves 103 extending over its entire circumference. The electrically insulating layer 12e, resistance heating member 13e in a layer form and release layer 14e are formed at and along the outer peripheral surface of the core roller 11e provided with the grooves 102 and 103. The electrically insulating layer 12e extends fully between the opposite ends of the core roller 11e. The release layer 14e extends between axially inner side surfaces of the current receiver members 31e, each of which is arranged between adjacent grooves 102 and 103 and will be described later in detail. The resistance heating member 13e extends between axially outer ends of the current receiver members 31e. Consequently, dust movement suppressing grooves (in other words, dust mevement restricting grooves) 104 which extend over the outer periphery of the heating roller 1e are formed at the outer peripheral surface of the heating roller 1e, and dust movement suppressing grooves (in other words, dust mevement restricting grooves) 105 located axially inside the grooves 104 are formed over the outer periphery of the heating roller 1e. The groove 104 has a width W3 of 1.5 mm and a depth D3 of 0.8 mm. The groove 105 has a width W4 of 1.5 mm and a depth D4 of 0.8 mm.

At an outer peripheral portion of the resistance heating member 13e axially outside each groove 105 and axially inside each groove 104 of the heating roller, there are arranged the current receiver member 31e and the current supply member 32e similarly to the fixing device shown in FIG. 10, so that a voltage is applied from a power supply (not shown) to the resistance heating member 13e through these members. In this fixing device, the current receiver member 31e and the current supply member 32e form the current transmitting unit 3e.

Parts of this fixing device are made of materials similar to those of the fixing device shown in FIG. 10.

According to this fixing device, it is possible to prevent or sufficiently suppress by a simple structure, i.e., provision of the dust movement suppressing grooves 104 and 105, movement of wear powder at the current transmitting units 3e to the sheet passing region P and the heating roller bearings 60, movement of the toner powder and paper powder to the current transmitting units 3e and the heating roller bearings 60 and movement of oil at the heating roller bearings 60 to the current transmitting units 3e and the sheet passing region P. Thereby, it is possible to prevent operation failure of the fixing device and lowering of the image quality of the fixed image.

The widths and depths of the grooves formed at the heating rollers 1e of the fixing devices shown in FIGS. 10 and 11 are not restricted to the above values, and can be appropriately selected from combinations of the widths and depths of the grooves, which are shown in the table 2 and can prevent movement of the toner powder, paper powder, wear powder, oil and others to the slide contact surfaces, bearings and sheet passing region.

A further embodiment of the invention will be described below with reference to FIG. 12.

Figure 12:
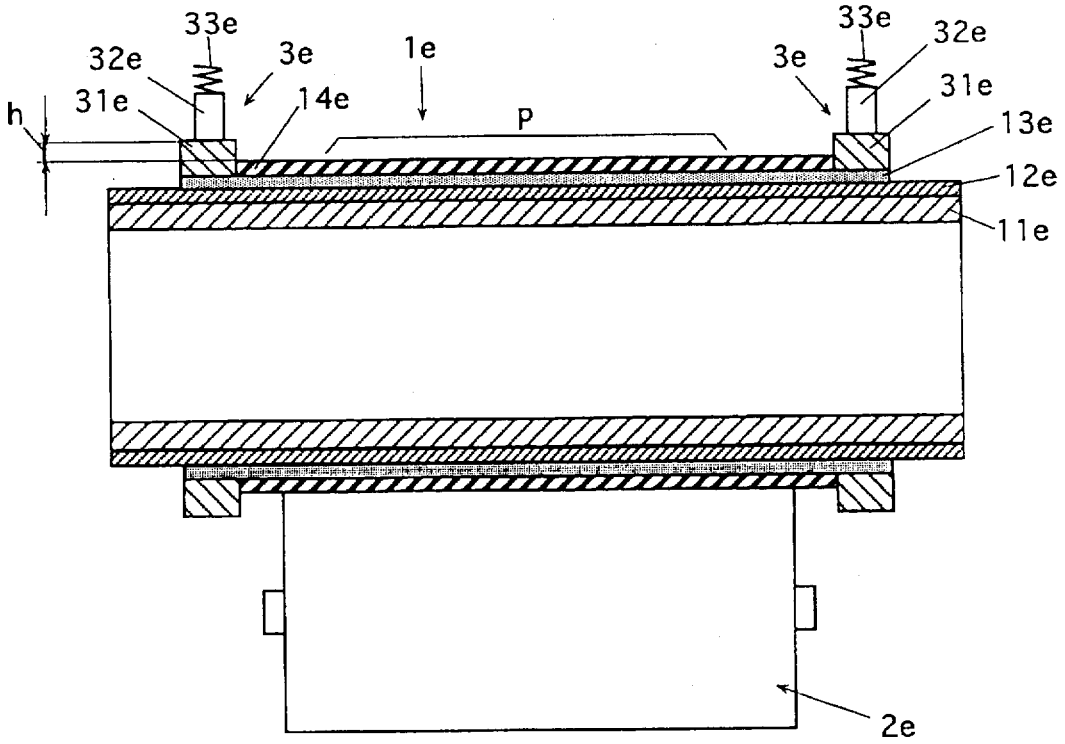

The fixing device shown in FIG. 12 is operable to heat and fix a toner image to a record paper sheet bearing the toner image, similarly to the fixing device already described. FIG. 12 is a schematic cross section of the device. Parts of the fixing device shown in FIG. 12 which have the substantially same structures and operations as those of the parts in the device shown in FIG. 10 bear the same reference numbers as those in FIG. 10.

Similarly to the foregoing embodiments, the fixing device of this embodiment has the heating roller 1e and the pressure roller 2e pressed thereto by the pressing means (not shown).

Similarly to the device shown in FIG. 11, the heating roller 1e is rotatably carried by carrying means (not shown) at positions axially outside the current transmitting units 3e to be described later, and is driven to rotate by drive means (not shown).

The heating roller 1e has a hollow cylindrical core roller 11e. The electrically insulating layer 12e, resistance heating member 13e in a layer form and release layer 14e layered in this order are formed at and along the outer peripheral surface of the core roller 11e. The electrically insulating layer 12e is formed fully between the opposite ends of the core roller 11e. The resistance heating member 13e is formed between axially outer ends of the paired current receiver members 31e to be described later. The release layer 14e is formed between axially inner side surfaces of the paired current receiver members 31e. The resistance heating member 13e, release layer 14e and electrically insulating layer 12e rotate together with the core roller 11e.

At the outer peripheral portions of the resistance heating member 13e, there are arranged a pair of circular ring-shaped current receiver members 31e, which are already described and fixed to the resistance heating member 13e. A radius of the outer periphery circle of these current receiver members 31e is larger by h=10 mm than the radius of the outer periphery circle of the sheet passing region P of the heating roller 1e, i.e., radius of the outer periphery circle of the portion of the heating roller 1e covered with the release layer 14e. The current receiver member 31e rotates together with the core roller 11e.

The paired current supply members 32e are arranged in contact with the outer peripheral surfaces of the current receiver members 31e. Similarly to the fixing device shown in FIG. 10, the power supply (not shown) can apply a voltage to the resistance heating member 13e. In this fixing device, each current receiver member 31e and each current supply member 32e form each current transmitting unit 3e.

The difference h between the radius of the outer periphery circle of each current receiver member 31e and the radius of the outer periphery circle of the heating roller 1e at the sheet passing region was selected from an experiment such that the voltage across the opposite ends of the resistance heating member 13e did not lower when the voltage was applied to the resistance heating member 13e while maintaining the power supply voltage constant. In this experiment, the voltage across the opposite ends of the resistance heating member 13e was measured in such conditions that a fixing device of the type shown in FIG. 12 was employed, the power supply voltage was maintained constant, the diameter of the heating roller 1e and the difference h were set to various values, the rotation speed of the heating roller 1e was set to 100 rpm, and each continuous operation was performed for 1000 hours. The results are shown in table 3. In the table 3, values such as "20%" represents the fact that the voltage across opposite ends of the resistance heating member 13e lowered 20% from the power supply voltage, and in other words, the fact that the voltage across the opposite ends of the resistance heating member 13e lowered to 80% of the power supply voltage.

TABLE 3

| | Diameter (mm) | | |
|---|---|---|---|
| Difference h (mm) | 20 | 40 | 60 |
| 2 | 20% | 20% | 20% |
| 4 | 20% | 10% | 10% |
| 6 | 0% | 10% | 0% |
| 8 | 0% | 0% | 0% |
| 10 | 0% | 0% | 0% |
| 12 | 0% | 0% | 0% |

It is understood from the table 3 that the difference h of about 6 mm or more can prevent or sufficiently suppress movement of toner powder, paper powder, oil and others to the current transmitting unit 3e. For achieving the dust movement suppressing effect more sufficiently, the difference h is preferably 8 mm or more, and more preferably, is 10 mm or more.

According to the fixing device shown in FIG. 12, only a simple structure that the radius of the outer periphery circle of the current receiver member 31e is larger by 10 mm than the radius of the outer periphery circle of the sheet passing region of the heating roller 1e can prevent or sufficiently suppress movement of wear powder, which is generated by slide contact between the current supply member 32e and current receiver member 31e, to the sheet passing region, movement of toner powder and paper powder generated at the sheet passing region P to the current transmitting unit 3e and further to the heating roller bearing (not shown) outside the same, and movement of oil at the heating roller bearing to the current transmitting unit 3e and further to the sheet passing region P.

The difference between the radius of the outer periphery circle of the current receiver member 31e and the radius of the outer periphery circle of the sheet passing region P of the heating roller 1e is not restricted to the above value of 10 mm. Provided that the radius of the outer periphery circle of each current receiver member 31e is larger by 6 mm or more, the difference can be appropriately selected from values, which can prevent or sufficiently suppress movement of toner powder, paper powder or the like to the current transmitting unit 3e and movement of wear powder to the sheet passing region P as shown in table 3, in view of the diameter of the heating roller, required performance of the fixing device and others.

Materials of the parts and portions of the fixing devices in the foregoing embodiments are not restricted to those already described.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fixing device for heating and fixing an unfixed image to a record member bearing said unfixed image, comprising:

a heating roller;

a backup member holding and passing said record member between said heating roller and the same; and current transmitting means for transmitting a current to said heating roller, wherein said heating roller includes a core roller, and a resistance heating member which is formed along an outer or inner peripheral surface of said core roller for integral rotation with the same and generates heat when a current is transmitted thereto through said current transmitting means, and is rotatably carried at opposite ends of said core roller by carrying means, and said current transmitting means is arranged at a position opposed to said carrying means with a wall of said core roller therebetween.

2. A fixing device according to claim 1, wherein said current transmitting means includes ring-shaped rotary current receiver members electrically connected to said resistance heating member and arranged at positions of said core roller opposed to said carrying means with a wall of said core roller therebetween, and current supply members being in slidable contact with outer or inner peripheral surfaces of said rotary current receiver members, respectively.

3. A fixing device according to claim 1, wherein said current transmitting means includes rotary current receiver members electrically connected to said resistance heating member and arranged at said core roller, and current supply members being in slidable contact with said rotary current receiver members, respectively, each of said current receiver members being in contact with said current supply member has at least one convex or concave contact surface, and each of said current supply members has a concave or convex contact surface being complementary in shape to and in contact with said convex or concave surface of said current receiver member.

4. A fixing device according to claim 3, wherein each of said current supply members is carried by a current supply member carrying holder and in contact with the corresponding current receiver member, and said current supply member carrying holder is movably carried by holder carrying means allowing movement in a direction crossing a moving direction for contact of said current supply member with said current receiver member so as to allow contact of said current supply member with said current receiver member in accordance with a shift of said current receiver member in a direction crossing said moving direction for contact.

5. A fixing device according to claim 3, wherein said resistance heating member is formed along an outer peripheral surface of said core roller, each of said rotary current receiver members has a circular ring-shaped configuration, each of said current supply members is in contact with an outer peripheral surface of said rotary current receiver member, each of said current supply members has a curved concave surface being in contact with the outer peripheral surface of said current receiver member and extending in the circumferential direction of said current receiver member, and a curvature radius R1 of an arc in the same direction as the circumferential direction of said current receiver member at said curved concave surface and a radius R2 of an outer periphery circle of said current receiver member being in contact with said arc satisfy a relationship of $R2<R1$.

6. A fixing device according to claim 3, wherein said resistance heating member is formed along an inner peripheral surface of said core roller, each of said rotary current receiver members has a circular ring-shaped configuration, each of said current supply members is in contact with an inner peripheral surface of said rotary current receiver member, each of said current supply members has a curved convex surface being in contact with the inner peripheral surface of said current receiver member and extending in the circumferential direction of said current receiver member, and a curvature radius R3 of an arc in the same direction as the circumferential direction of said current receiver member at said curved convex surface and a radius R4 of an inner periphery circle of said current receiver member being in contact with said arc satisfy a relationship of R3<R4.

7. A fixing device according to claim 3, wherein said resistance heating member is formed along the outer peripheral surface of said core roller, each of said rotary current receiver members has a ring-shaped configuration, and an outer periphery circle of at least one of side surfaces of each of said current receiver members has a radial difference of 6 mm or more with respect to an outer periphery circle of a record member passing region at said heating roller.

8. A fixing device according to claim 1, wherein said resistance heating member is formed along an outer peripheral surface of said core roller, said current transmitting means includes circular ring-like rotary current receiver members electrically connected to said resistance heating member and arranged at said core roller, and current supply members being in slidable contact with outer peripheral surfaces of said rotary current receiver members, respectively, each of said current supply members has a curved concave surface being in contact with the outer peripheral surface of said current receiver member and extending in the circumferential direction of said current receiver member, and a curvature radius R1 of an arc in the same direction as the circumferential direction of said current receiver member at said curved concave surface and a radius R2 of an outer periphery circle of said current receiver member being in contact with said arc satisfy a relationship of R2<R1.

9. A fixing device according to claim 8, wherein a width of said current supply member in the direction of the rotation axis of said heating roller is equal to or smaller than a width of said current receiver member in the same direction.

10. A fixing device according to claim 1, wherein said resistance heating member is formed along an inner peripheral surface of said core roller, said current transmitting means includes circular ring-like rotary current receiver members electrically connected to said resistance heating member and arranged at said core roller, and current supply members being in slidable contact with inner peripheral surfaces of said rotary current receiver members, respectively, each of said current supply members has a curved convex surface being in contact with the inner peripheral surface of said current receiver member and extending in the circumferential direction of said current receiver member, and a curvature radius R3 of an arc in the same direction as the circumferential direction of said current receiver member at said curved convex surface and a radius R4 of an inner periphery circle of said current receiver member being in contact with said arc satisfy a relationship of R3<R4.

11. A fixing device according to claim 10, wherein a width of said current supply member in the direction of the rotation axis of said heating roller is equal to or smaller than a width of said current receiver member in the same direction.

12. A fixing device for heating and fixing an unfixed image to a record member bearing said unfixed image, comprising:

a rotatably carried heating roller;

a backup member holding and passing said record member between said heating roller and the same; and current transmitting means for transmitting a current to said heating roller, wherein said heating roller includes a core roller and a resistance heating member formed at said core roller for rotation together with said core roller and is adapted to generate heat when a current is transmitted thereto through said current transmitting means; and said current transmitting means includes rotary current receiver members electrically connected to said resistance heating member and arranged at said core roller, and current supply members being in slidable contact with said rotary current receiver members, respectively, each of said current receiver members being in contact with said current supply member has at least one convex or concave contact surface, and each of said current supply members has a concave or convex contact surface being complementary in shape to and in contact with said convex or concave surface of said current receiver member.

13. A fixing device according to claim 12, wherein each of said current supply members is carried by a current supply member carrying holder and in contact with the corresponding current receiver member, and said current supply member carrying holder is movably carried by holder carrying means allowing movement in a direction crossing a moving direction for contact of said current supply member with said current receiver member so as to allow contact of said current supply member with said current receiver member in accordance with a shift of said current receiver member in a direction crossing said moving direction for contact.

14. A fixing device according to claim 12, wherein said resistance heating member is formed along the outer peripheral surface of said core roller, each of said rotary current receiver members has a circular ring-shaped configuration, each of said current supply members is in contact with an outer peripheral surface of said current receiver member and has a curved concave surface being in contact with the outer peripheral surface of said current receiver member and extending in the circumferential direction of said current receiver member, and a curvature radius R1 of an arc in the same direction as the circumferential direction of said current receiver member at said curved concave surface and a radius R2 of an outer periphery circle of said current receiver member being in contact with said arc satisfy a relationship of R2<R1.

15. A fixing device according to claim 12, wherein said resistance heating member is formed along the inner peripheral surface of said core roller, each of said rotary current receiver members has a circular ring-shaped configuration, each of said current supply members is in contact with an inner peripheral surface of said current receiver member and has a curved convex surface being in contact with the inner peripheral surface of said current receiver member and extending in the circumferential direction of said current receiver member, and a curvature radius R3 of an arc in the same direction as the circumferential direction of said current receiver member at said curved convex surface and a radius R4 of an inner periphery circle of said current receiver member being in contact with said arc satisfy a relationship of R3<R4.

16. A fixing device according to claim 12, wherein said resistance heating member is formed along the outer peripheral surface of said core roller, the outer peripheral surface of said heating roller is provided at the vicinity of each of said current receiver members with at least one dust movement restricting groove over the entire periphery of said heating roller.

17. A fixing device according to claim 12, wherein said resistance heating member is formed along the outer peripheral surface of said core roller, each of said rotary current receiver members has a ring-shaped configuration, and an outer periphery circle of at least one of side surfaces of each of said current receiver members has a radial difference of 6 mm or more with respect to an outer periphery circle of a record member passing region at said heating roller.

18. A fixing device for heating and fixing an unfixed image to a record member bearing said unfixed image, comprising:

a rotatably carried heating roller;

a backup member holding and passing said record member between said heating roller and the same; and current transmitting means for transmitting a current to said heating roller, wherein said heating roller includes a core roller and a resistance heating member formed at an outer peripheral surface of said core roller for rotation together with said core roller and is adapted to generate heat when a current is transmitted thereto through said current transmitting means, and said current transmitting means includes circular ring-shaped rotary current receiver members electrically connected to said resistance heating member and arranged at said core roller, and current supply members being in slidable contact with said rotary current receiver members, respectively, each of said current supply members has a curved concave surface being in contact with the outer peripheral surface of said current receiver member and extending in the circumferential direction of said current receiver member, and a curvature radius R1 of an arc in the same direction as the circumferential direction of said current receiver member at said curved concave surface and a radius R2 of an outer periphery circle of said current receiver member being in contact with said arc satisfy a relationship of R2<R1.

19. A fixing device according to claim 18, wherein a width of said current supply member in the direction of the rotation axis of said heating roller is equal to or smaller than a width of said current receiver member in the same direction.

20. A fixing device according to claim 19, wherein an outer periphery circle of at least one of side surfaces of each of said current receiver members has a radial difference of 6 mm or more with respect to an outer periphery circle of a record member passing region at said heating roller.

21. A fixing device according to claim 18, wherein the outer peripheral surface of said heating roller is provided at the vicinity of each of said current receiver members with at least one dust movement restricting groove over the entire periphery of said heating roller.

22. A fixing device according to claim 18, wherein an outer periphery circle of at least one of side surfaces of each of said current receiver members has a radial difference of 6 mm or more with respect to an outer periphery circle of a record member passing region at said heating roller.

23. A fixing device for heating and fixing an unfixed image to a record member bearing said unfixed image, comprising:

a rotatably carried heating roller;

a backup member holding and passing said record member between said heating roller and the same; and current transmitting means for transmitting a current to said heating roller, wherein said heating roller includes a core roller, and a resistance heating member which is formed along an inner peripheral surface of said core roller for integral rotation with the same and generates heat when a current is transmitted thereto through said current transmitting means, and said current transmitting means includes circular ring-shaped rotary current receiver members electrically connected to said resistance heating member and arranged at said core roller, and current supply members being in slidable contact with the inner peripheral surface of said rotary current receiver members, respectively, each of said current supply members has a curved convex surface being in contact with the inner peripheral surface of said current receiver member and extending in the circumferential direction of said current receiver member, and a curvature radius R3 of an arc in the same direction as the circumferential direction of said current receiver member at said curved convex surface and a radius R4 of an inner periphery circle of said current receiver member being in contact with said arc satisfy a relationship of R3<R4.

24. A fixing device according to claim 23, wherein a width of said current supply member in the direction of the rotation axis of said heating roller is equal to or smaller than a width of said current receiver member in the same direction.

25. A fixing device according to claim 23, wherein an inner periphery circle of at least one of side surfaces of each of said current receiver members has a radial difference of 6 mm or more with respect to an inner periphery circle of a record member passing region at said heating roller.

26. A fixing device for heating and fixing an unfixed image to a record member bearing said unfixed image, comprising:

a rotatably carried heating roller;

a backup member holding and passing said record member between said heating roller and the same; and current transmitting means for transmitting a current to said heating roller, wherein said heating roller includes a core roller, and a resistance heating member which is formed along an outer peripheral surface of said core roller for integral rotation with the same and generates heat when a current is transmitted thereto through said current transmitting means, said current transmitting means includes rotary current receiver members electrically connected to said resistance heating member and arranged at said core roller, and current supply members being in slidable contact with said rotary current receiver members, respectively, and the outer peripheral surface of said heating roller is provided at the vicinity of each of said current receiver members with at least one dust movement restricting groove over the entire periphery of said heating roller.

27. A fixing device according to claim 26, wherein said heating roller is rotatably carried at opposite ends of said core roller by carrying means, and said current transmitting means is arranged at a position opposed to said carrying means with a wall of said core roller therebetween.

28. A fixing device for heating and fixing an unfixed image to a record member bearing said unfixed image, comprising:

a rotatably carried heating roller;

a backup member holding and passing said record member between said heating roller and the same; and current transmitting means for transmitting a current to said heating roller, wherein said heating roller includes a core roller, and a resistance heating member which is formed along an outer peripheral surface of said core roller for integral rotation with the same and generates heat when a current is transmitted thereto through said current transmitting means, said current transmitting means includes ring-shaped rotary current receiver members electrically connected to said resistance heating member and arranged at said core roller, and current supply members being in slidable contact with said rotary current receiver members, respectively, and an outer periphery circle of at least one of side surfaces of each of said current receiver members has a radial difference of 6 mm or more with respect to an outer periphery circle of a record member passing region at said heating roller.

29. A fixing device according to claim 28, wherein said heating roller is rotatably carried at opposite ends of said core roller by carrying means, and said current transmitting means is arranged at a position opposed to said carrying means with a wall of said core roller therebetween.

* * * * *